US011382184B2

(12) United States Patent
Yun et al.

(10) Patent No.: US 11,382,184 B2
(45) Date of Patent: Jul. 5, 2022

(54) COOKING APPARATUS AND CONTROL METHOD THEREOF

(71) Applicant: Samsung Electronics Co., Ltd., Suwon-si (KR)

(72) Inventors: Chang Sun Yun, Suwon-si (KR); Dong Oh Kang, Suwon-si (KR); Byung Hwan Ko, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 444 days.

(21) Appl. No.: 16/425,810

(22) Filed: May 29, 2019

(65) Prior Publication Data

US 2019/0373683 A1 Dec. 5, 2019

(30) Foreign Application Priority Data

May 29, 2018 (KR) ..... 10-2018-0061141

(51) Int. Cl.
*H05B 6/06* (2006.01)
*H05B 6/12* (2006.01)
*H05B 6/66* (2006.01)

(52) U.S. Cl.
CPC ..... *H05B 6/065* (2013.01); *H05B 6/1272* (2013.01); *H05B 6/664* (2013.01)

(58) Field of Classification Search
CPC ..... F27B 5/14; H05B 2206/02; H05B 6/102; H05B 6/129; H05B 6/44
USPC ..... 219/620, 645, 650, 660–668, 670–672; 363/56.02, 52, 53, 54
See application file for complete search history.

(56) References Cited

U.S. PATENT DOCUMENTS

2015/0201467 A1* 7/2015 Yun ..... H05B 6/062 219/626
2016/0010175 A1* 1/2016 Horino ..... H05B 6/108 219/636
2016/0029439 A1* 1/2016 Kurose ..... H05B 6/1209 219/626

FOREIGN PATENT DOCUMENTS

| | | | |
|---|---|---|---|
| EP | 3026982 | A1 | 6/2016 |
| KR | 10-2012-0109965 | A | 10/2012 |
| KR | 10-2017-0115707 | A | 10/2017 |
| KR | 10-2017-0130762 | A | 11/2017 |
| WO | 2013/064968 | A2 | 5/2013 |
| WO | 2014/033580 | A1 | 3/2014 |

OTHER PUBLICATIONS

European Search Report dated Oct. 14, 2019 in connection with European Patent Application No. 19 17 7292, 9 pages.

* cited by examiner

*Primary Examiner* — Quang T Van

(57) ABSTRACT

Disclosed herein is a cooking apparatus and a control method thereof. The cooking apparatus includes first and second coils arranged in a first column, third and fourth coils arranged in a second column, a plurality of inverters configured to supply a drive current to the first, second third and fourth coils, a plurality of rectifiers configured to supply direct current (DC) power to the plurality of inverters, a plurality of switches configured to connect each of the plurality of rectifiers to any one of a first external power supply and a second external power supply, and a controller configured to control the plurality of switches wherein the first external power supply supplies power to at least one of the first, second, third, and fourth coils and the second external power supply supplies power to at least one of the first, second, third, and fourth coils.

15 Claims, 26 Drawing Sheets

COOKING APPARATUS AND CONTROL METHOD THEREOF

CROSS-REFERENCE TO RELATED APPLICATION

This application is based on and claims priority under 35 U.S.C. § 119 to Korean Patent Application No. 10-2018-0061141, filed on May 29, 2018, in the Korean Intellectual Property Office, the disclosure of which is incorporated by reference herein in its entirety.

BACKGROUND

1. Field

The disclosure relates to a cooking apparatus and a control method thereof, and more particularly to a cooking apparatus having a plurality of induction coils and a control method thereof.

2. Description of Related Art

In general, an induction heating cooker is a cooking appliance for heating a cooking vessel using the principle of induction heating for cooking. The induction heating cooker may include a cooking table on which a cooking vessel is put, and a coil configured to generate a magnetic field using an electric current.

When the current is applied to the coil to generate a magnetic field, a secondary current is induced in the cooking vessel, and joule heat is generated by the electrical resistance component of the cooking vessel itself. The cooking vessel is heated by the joule heat and food contained in the cooking vessel is heated.

In comparison with a gas range or a kerosene stove in which fossil fuels such as gas or oil are burned and the cooking vessel is heated through the heat of combustion thereof, the induction heating cooker provides faster heating without harmful gas and the risk of fire.

Recently, a new induction heating cooker has been developed and the new induction heating cooker is capable of automatically heating a cooking vessel if the cooking vessel is placed in at any location on the induction heating cooker. The induction heating cooker includes a plurality of coils.

SUMMARY

Therefore, it is an aspect of the present disclosure to provide a cooking apparatus capable of increasing a magnitude of a magnetic field output by coils overlapped with a cooking vessel, and a control method thereof.

It is another aspect of the present disclosure to provide a cooking apparatus capable of supplying power to each coil overlapped with a cooking vessel from a plurality of external power supplies, and a control method thereof.

It is another aspect of the present disclosure to provide a cooking apparatus capable of supplying power to each of a plurality of inverters from each of a plurality of rectifiers, and a control method thereof Additional aspects of the present disclosure will be set forth in part in the description which follows and, in part, will be obvious from the description, or may be learned by practice of the present disclosure.

In accordance with an aspect of the disclosure, a cooking apparatus includes first and second coils arranged in a first column, third and fourth coils arranged in a second column, a plurality of inverters configured to supply a drive current to the first, second third and fourth coils, a plurality of rectifiers configured to supply direct current (DC) power to the plurality of inverters, a plurality of switches configured to connect each of the plurality of rectifiers to any one of a first external power supply and a second external power supply, and a controller configured to control the plurality of switches wherein the first external power supply supplies power to at least one of the first, second, third, and fourth coils and the second external power supply supplies power to at least one of the first, second, third, and fourth coils.

Based on whether a sum of power of the first coil and power of the second coil is greater than reference power, the controller may control the plurality of switches wherein the first external power supply supplies power to the first coil and the second external power supply supplies power to the second coil.

Based on whether the power of the first coil is greater than the power of the second coil, the controller may control the plurality of switches wherein the second external power supply supplies power to the third and fourth coils.

The plurality of inverters may include first, second, third and fourth inverters configured to supply a drive current to the first, second, third, and fourth coils, respectively, the plurality of rectifiers may include first, second, third and fourth rectifiers configured to supply DC power to the first, second, third, and fourth inverters, respectively, and the plurality of switches may include first, second, third and fourth three-contact switches configured to connect each of the first, second, third and fourth rectifiers to any one of the first and second external power supplies.

Based on whether the sum of the power of the first coil and the power of the second coil is greater than the reference power, the controller may control the first and second three-contact switches wherein the first rectifier is connected to the first external power supply and the second rectifier is connected to the second external power supply.

Based on whether the power of the first coil is greater than the power of the second coil, the controller may control the third and fourth three-contact switches wherein the third and fourth rectifiers are connected to the second external power supply.

The plurality of inverters may include first, second, third and fourth inverters configured to supply a drive current to the first, second, third, and fourth coils, respectively, the plurality of rectifiers may include first and second rectifiers configured to supply DC power to the first and second inverters, respectively and a third rectifier configured to supply DC power to the third and fourth inverters, and the plurality of switches may include first, second, and third three-contact switches configured to connect each of the first, second and third rectifiers to any one of the first and second external power supplies.

Based on whether the sum of the power of the first coil and the power of the second coil is greater than the reference power, the controller may control the first and second three-contact switches wherein the first rectifier is connected to the first external power supply and the second rectifier is connected to the second external power supply.

Based on whether the power of the first coil is greater than the power of the second coil, the controller may control the third three-contact switch wherein the third rectifier is connected to the second external power supply.

In accordance with another aspect of the disclosure, a control method of the cooking apparatus configured to supply power from first and second external power supplies to first, second, third and fourth coils, the control method includes identifying power of each of the first, second, third and fourth coils based on a user input, and based on whether a sum of power of the first coil and power of the second coil is greater than reference power, supplying power from the first external power supply to the first coil and supplying power from the second external power supply to the second coil.

The control method may further include based on whether the power of the first coil is greater than the power of the second coil, supplying power from the second external power supply to the third and fourth coils.

Power may be supplied from the first and second external power supplies to the first, second, third and fourth coils by using first, second, third and fourth switches configured to connect each of the first, second, third and fourth coils to any one of the first and second external power supplies.

The control method may further include based on whether the sum of the power of the first coil and the power of the second coil is greater than the reference power, controlling the first and second switches wherein the first coil is connected to the first external power supply and the second coil is connected to the second external power supply.

The control method may further include based on whether the power of the first coil is greater than the power of the second coil, controlling the first and second switches wherein the third and fourth rectifiers are connected to the second external power supply.

The control method may further include when the sum of the power of the first coil and the power of the second coil is not greater than the reference power and when a sum of power of the third coil and power of the fourth coil is not greater than the reference power, supplying power from the first external power supply to the first and second coils and supplying power from the second external power supply to the third and fourth coils.

In accordance with another aspect of the disclosure, a cooking apparatus includes a plurality of coils, a plurality of inverters configured to supply a drive current to each of the plurality of coils, a plurality of rectifiers configured to supply direct current (DC) power to each of the plurality of inverters, a plurality of switches configured to connect each of the plurality of rectifiers to any one of a first external power supply and a second external power supply, and a controller configured to control the plurality of switches wherein the first external power supply supplies power to coils in a first group, among the plurality of coils and the second external power supply supplies power to coils in a second group, among the plurality of coils.

Based on whether a sum of power of the first group coils is greater than reference power, the controller may control the plurality of switches wherein the first and second external power supplies supply power to the first group coils.

Based on whether power of any one coil of the plurality of coils is greater than reference power, the controller may control the plurality of switches wherein the first external power supply supplies power to the any one coil and the second external power supply supplies power to the other coils.

The first group coils may be arranged in a first column and the second group coils are arranged in a second column.

The number of the plurality of inverters may be identical to the number of the plurality of rectifiers.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
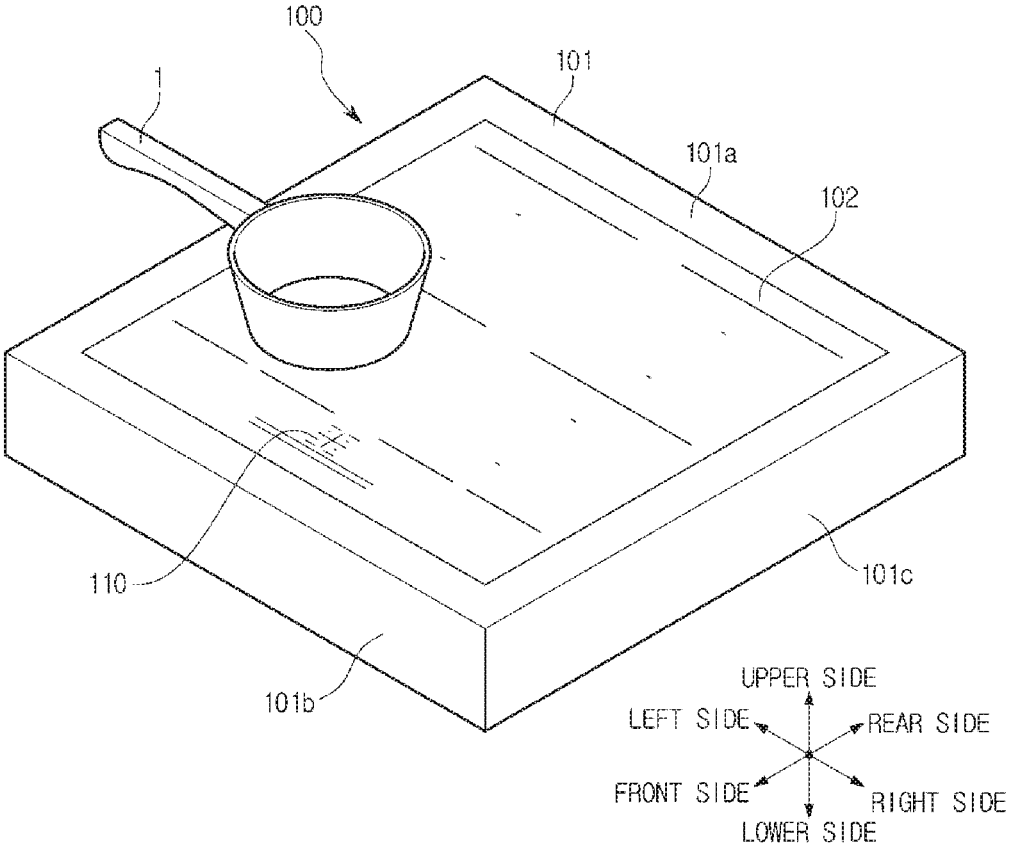
FIG. 1 illustrates a view of an exterior of a cooking apparatus according to an embodiment of the disclosure.

FIGS. 1 through 26, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing operations described is an example; however, the sequence of and/or operations is not limited to that set forth herein and may be changed as is known in the art, with the exception of operations necessarily occurring in a particular order. In addition, respective descriptions of well-known functions and constructions may be omitted for increased clarity and conciseness.

Additionally, various embodiments will now be described more fully hereinafter with reference to the accompanying drawings. The various embodiments may, however, be embodied in many different forms and should not be construed as being limited to the embodiments set forth herein. These embodiments are provided so that this disclosure will be thorough and complete and will fully convey the various embodiments to those of ordinary skill in the art. Like numerals denote like elements throughout.

It will be understood that, although the terms first, second, etc. may be used herein to describe various elements, these elements should not be limited by these terms. These terms are only used to distinguish one element from another. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present.

The terminology used herein is for the purpose of describing particular embodiments only and is not intended to be limiting. As used herein, the singular forms "a," "an," and "the," are intended to include the plural forms as well, unless the context clearly indicates otherwise.

Reference will now be made in detail to the various embodiments of the present disclosure, examples of which are illustrated in the accompanying drawings, wherein like reference numerals refer to like elements throughout.

The expression, "at least one of a, b, and c," should be understood as including only a, only b, only c, both a and b, both a and c, both b and c, or all of a, b, and c.

Reference will now be made in detail to embodiments of the disclosure, examples of which are illustrated in the accompanying drawings.

Figure 2:
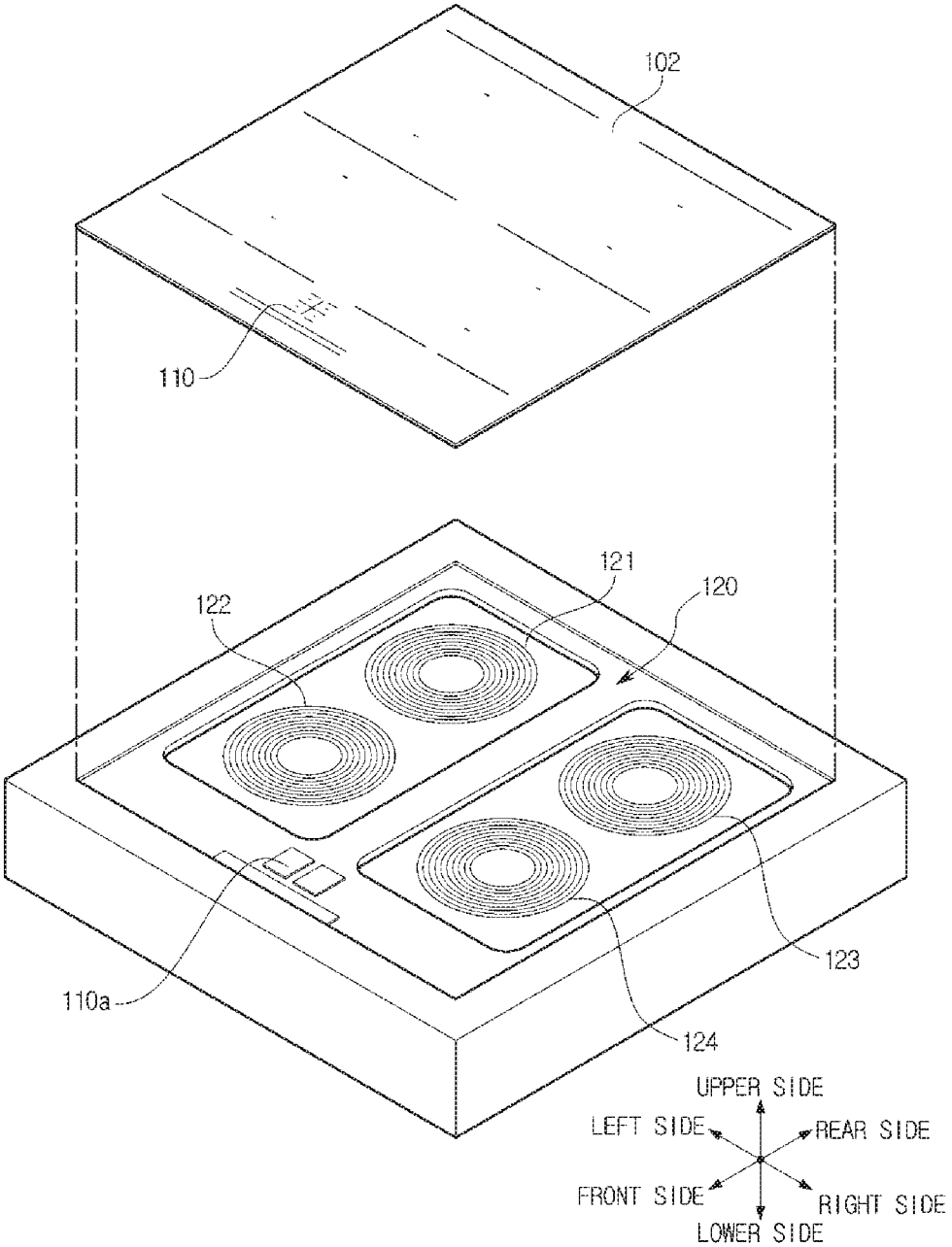
FIG. 2 illustrates a view of an interior of the cooking apparatus according to an embodiment of the disclosure.
Figure 3:
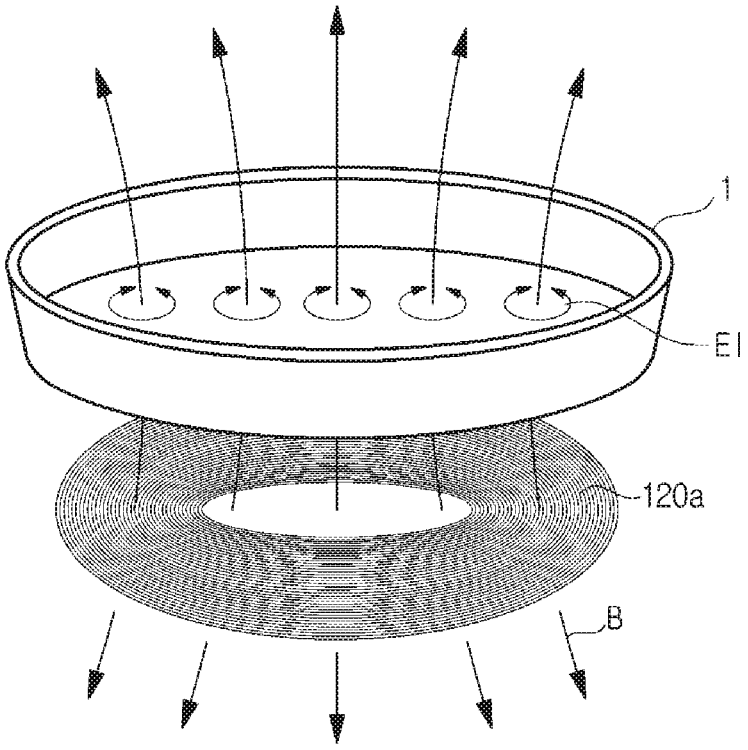
FIG. 3 illustrates a view of an example in which the cooking apparatus according to an embodiment of the disclosure heats a cooking vessel.

FIG. 1 illustrates a view of an exterior of a cooking apparatus according to an embodiment of the disclosure. FIG. 2 illustrates a view of an interior of the cooking apparatus according to an embodiment of the disclosure. FIG. 3 illustrates a view of an example in which the cooking apparatus according to an embodiment of the disclosure heats a cooking vessel.

As illustrated in FIG. 1, a cooking apparatus 100 includes a body 101 forming an appearance thereof and on which various components forming the cooking apparatus 100 are installed.

On an upper surface 101*a* of the body 101, a cooking plate 102 having a flat plate shape on which a cooking vessel 1 is placed is provided. The cooking plate 102 may be formed of a reinforcing glass such as a ceramic glass so as not to be easily broken.

On one side of the cooking plate 102, a user interface 110 receiving control commands from a user and displaying operation information of the cooking apparatus 100 may be installed. However, the position of the user interface 110 is not limited to a position on the cooking plate 102 but may be installed on at various positions such as the front surface 101*b* and/or a side surface 101*c* of the body 101.

As illustrated in FIG. 2, a plurality of coils 120: 121, 122, 123, and 124 configured to heat the cooking vessel 1 and a main circuit board assembly 110*a* configured to implement the user interface 110 may be installed under the cooking plate 102.

The plurality of coils 120 each may generate a magnetic field and/or an electric field and/or an electromagnetic field for heating the cooking vessel 1.

For example, when a drive current is supplied to a coil 120*a* as illustrated in FIG. 3, a magnetic field B may be induced around the coil 120*a*. Particularly, when a current having magnitudes and directions changing in time, that is, an alternating current, is supplied to the coil 120*a*, the magnetic field B having the magnitude and direction changing in time may be induced around the coil 120*a*.

The magnetic field B around the coil 120*a* may pass through the cooking plate 102 formed of tempered glass and then reach the cooking vessel 1 placed on the cooking plate 102.

An eddy current EI rotating around the magnetic field B may occur in the cooking vessel 1 due to the magnetic field B having the magnitude and direction changing with time. The phenomenon that an eddy current is generated due to the magnetic field B changing in time is referred to as electromagnetic induction phenomenon. Heat caused by electrical resistance may be generated in the cooking vessel 1 due to eddy currents EI. Heat generated by electrical resistance is heat generated in a resistor when a current flows through the resistor, which is also referred to as a joule heat. The cooking vessel 1 is heated by the heat caused by the electrical resistance, and food contained in the cooking vessel 1 may be heated.

As described above, the plurality of coils 120 each may heat the cooking vessel 1 using heat due to electromagnetic induction and the electrical resistance.

The plurality of coils 120 may be arranged in a predetermined pattern under the cooking plate 102. The plurality of coils 120 may be arranged as a matrix with columns and rows. In other words, the plurality of coils 120 may be arranged at predetermined intervals from the front to the rear of the body 101, and may be arranged at predetermined intervals from the right side to the left side of the body 101. For example, the plurality of coils 120 may include a first coil 121, a second coil 122, a third coil 123, and a fourth coil 124. The first and second coils 121 and 122 may be arranged in a first column (a left column of the cooking plate) and the third and fourth coils 123 and 124 may be arranged in a second column (a right column of the cooking plate).

Arrangement of the plurality of coils 120 is not limited to the arrangement illustrated in FIG. 2, and thus the plurality of coils 120 may be arranged in various forms. For example, the plurality of coils 120 may be arranged in the form of a honeycomb to allow a distance among the plurality of coils 120 to be minimized.

The main circuit board assembly 110*a* implementing the user interface 110 may be provided under the user interface 110 installed at one side of the cooking plate 102. The main circuit board assembly 110*a* may be a printed board assembly (PBA) including a display, a switching element and an integrated circuit element, and a printed circuit board (PCB), on which the display, the switching element, and the integrated circuit element are installed, for implementing the user interface 110.

The position of the main circuit board assembly 110*a* is not limited to that illustrated in FIG. 2, and may be arranged at various positions. For example, when the user interface 110 is installed on the front surface 101*b* of the body 101, the main circuit board assembly 110*a* may be installed behind the front surface 101*b* of the body 101.

Under the plurality of coils 120, a printed circuit board assembly (not shown) configured to operate the plurality of coils 120 may be installed. A driver circuit configured to supply a drive current to the plurality of coils 120 and a control circuit configured to control the operation of the plurality of coils 120 may be installed on a plurality of printed circuit board assemblies.

As mentioned above, the cooking apparatus 100 may include the plurality of coils 120 configured to heat the cooking vessel 1, and the driver circuit and the control circuit configured to operate the plurality of coils 120.

Hereinafter a configuration and a function of the configuration of the cooking apparatus 100 will be described in more detail.

Figure 4:
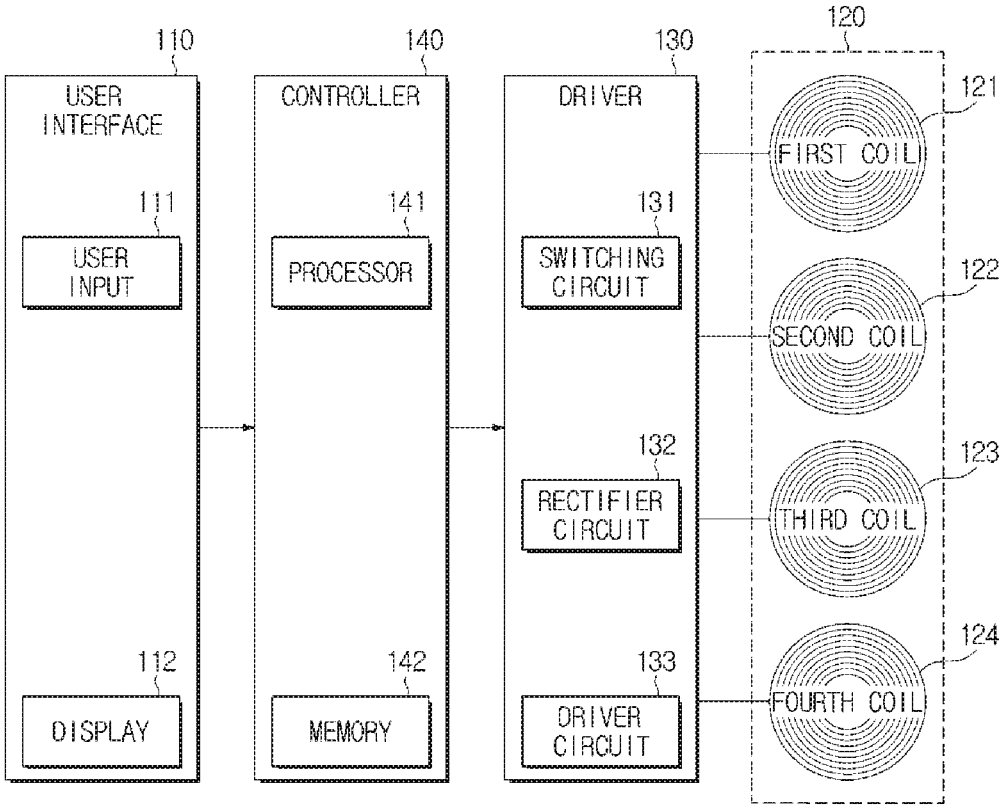
FIG. 4 illustrates a view of a configuration of the cooking apparatus according to an embodiment of the disclosure.
Figure 5:
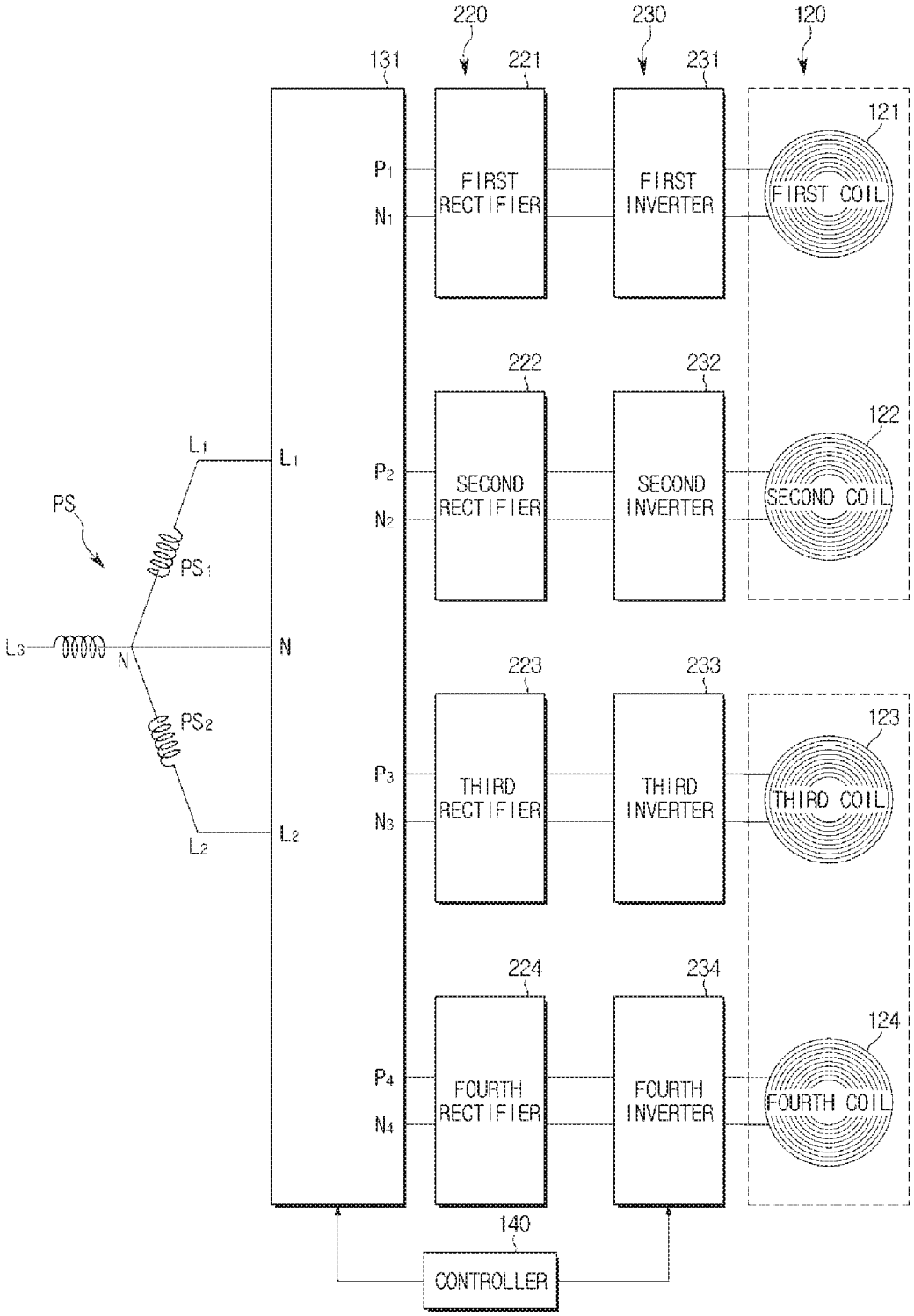
FIG. 5 illustrates a view of an example of a driver contained in the cooking apparatus according to an embodiment of the disclosure.

FIG. 4 illustrates a view of a configuration of the cooking apparatus according to an embodiment of the disclosure. FIG. 5 illustrates a view of an example of a driver contained in the cooking apparatus according to an embodiment of the disclosure.

As illustrated in FIG. 4, the cooking apparatus 100 includes the user interface 110, the plurality of coils 120, a driver 130 and a controller 140.

The user interface 110 may include a user input 111 receiving a control command from a user and a display 112 displaying an image related to the operation of the cooking apparatus 100.

The user input 111 may include an input button receiving a predetermined control command and a touch pad receiving various control commands according to an image displayed on the display 112.

The input button may include a plurality of buttons receiving a predetermined control command from the user and transmitting an electrical signal corresponding to the user's control command to the controller 140. For example, the input button may include an operation button receiving a power on/off command of the cooking apparatus 100, and a power-up button and a power-down button receiving a magnitude of the magnetic field and/or the electromagnetic field output by the coils 120 of the cooking apparatus 100. The input button may be implemented with various types of buttons (or switches) such as a push button, a slide button, a toggle button, a touch button, and a dial.

The touch pad may receive a touch input from a user and transmit coordinates of the received touch input to the controller 140. The controller 140 may identify the user's control command based on the coordinates of the touch input.

The display 112 may display an image related to the operation of the cooking apparatus 100. For example, the display 112 may display an image indicating whether the coils 120 of the cooking apparatus 100 are in operation, and an image indicating the magnitude of the magnetic field and/or the electromagnetic field output by the coils 120.

The display 112 may include a light emitting diode (LED), a liquid crystal display (LCD), or an organic light emitting diode (OLED).

The user input 111 and the display 112 may be integrally formed. For example, the touch pad and the display may form a touch screen panel (TSP) integrally. The display may display an image for receiving a user's touch input, and the touch pad may receive a user's touch input. The controller 140 may identify the user's control command based on the coordinates of the touch input of the user.

As mentioned above, the user interface 110 may receive the control command from the user, and transmit the electrical signal corresponding to the user's control command to the controller 140. The user interface 110 may receive information on the operation of the cooking apparatus 100 from the controller 140 and display an image indicating the operation of the cooking apparatus 100.

For example, the user interface 110 may display an image indicating a position of the cooking vessel 1 placed on the cooking plate 102, on the display 112. In addition, the user interface 110 may receive the touch input of the user indicating a selection of the cooking vessel 1 through the user input 111, and transmit the touch input of the user to the controller 140. When the user inputs an output increase command of the cooking apparatus 100 through the user input 111, the user interface 110 may transmit an electrical signal indicating the output increase command to the controller 140, and when the user inputs an output decrease command of the cooking apparatus 100 through the user input 111, the user interface 110 may transmit an electrical signal indicating the output decrease command to the controller 140.

When the cooking vessel 1 is placed on the cooking plate 102, the plurality of coils 120 each may generate the magnetic field and/or the electromagnetic field for heating the cooking vessel 1.

As mentioned above, the plurality of coils 120 may include the first coil 121, the second coil 122, the third coil 123 and the fourth coil 124. The first and second coils 121 and 122 may be arranged in the left column of the cooking plate 102 and the third and fourth coils 123 and 124 may be arranged in the right column of the cooking plate 102.

The driver 130 may be supplied with power from an external power supply PS and may supply the drive current to the plurality of coils 120 according to the driving control signal of the controller 140. Particularly, a driver circuit 133 may apply an alternating current (AC) and output an alternating current (drive current) voltage to the plurality of coils 120 in accordance with the control signal of the controller 140.

The driver 130 includes the driver circuit 133, a rectifier circuit 132, and a switching circuit 131.

The driver circuit 133 may include a plurality of inverters 230. Each of the plurality of inverters 230: 231, 232, 233, and 234 may receive a direct current (DC) voltage and a direct current (DC) from the rectifier circuit 132, and apply an AC voltage and supply an AC to each of the plurality of coils 120.

The plurality of inverters 230 may include a first inverter 231 supplying a drive current to the first coil 121, a second inverter 232 supplying a drive current to the second coil 122, a third inverter 233 supplying a drive current to the third coil 123 and a fourth inverter 234 supplying a drive current to the fourth coil 124.

Although the first, second, third and fourth inverters 231, 232, 233 and 234 are illustrated in FIG. 5, the number of the inverters 230 is not limited to four. The number of the plurality of inverters 230 contained in the driver circuit 133 may be equal to the number of the plurality of coils 120 or may be smaller than the number of the plurality of coils 120.

The rectifier circuit 132 may include a plurality of rectifiers 220. Each of the plurality of rectifiers 220: 221, 222, 223, and 224 may be supplied with an AC voltage and an AC from the external power supply PS via the switching circuit 131, and the plurality of rectifiers 220: 221, 222, 223, and 224 may apply a DC voltage and supply a DC to the plurality of inverters 231, 232, 233, and 234, respectively.

The plurality of rectifiers 220 may include a first rectifier 221 supplying direct current (DC) power to the first inverter 231, a second rectifier 222 supplying the DC power to the second inverter 232, a third rectifier 223 supplying the DC power to the third inverter 233, and a fourth rectifier 224 supplying the DC power to the fourth inverter 234.

Although the first, second, third, and fourth rectifiers 221, 222, 223, and 224 are illustrated in FIG. 5, the number of the rectifiers 220 is not limited to four. The number of the plurality of rectifiers 220 contained in the rectifier circuit 132 may be equal to the number of the plurality of inverters 230 or may be smaller than the number of the plurality of inverters 230.

The external power supply PS may include external power supplies capable of supplying alternating current (AC) power having different phases to the cooking apparatus 100.

The power supplied to home and/or the workplace may be single-phase alternating current (AC) power or three-phase alternating current (AC) power. In a power plant, three-phase AC power is generated and the voltage of the three-phase AC power may drop in the substation. At this time, the power may be supplied to the home and/or workplace as three-phase AC power, or may be supplied to the home and/or workplace after converted into the single-phase AC power.

Hereinafter for the understanding, it is assumed that three-phase AC power is supplied to the home and/or the workplace.

The external power supply PS supplied to the home and/or the workplace may include a first phase terminal L1, a second phase terminal L2, a third phase terminal L3 and a neutral terminal N. In other words, the first phase terminal L1, the second phase terminal L2, the third phase terminal L3 and the neutral terminal N may be provided from the outside to the home and/or the workplace.

First AC power is supplied from the first phase terminal L1 and the neutral terminal N, and between the first phase terminal L1 and the neutral terminal N may be defined as a first external power supply PS1. Second AC power is supplied from the second phase terminal L2 and the neutral terminal N, and between the second phase terminal L2 and the neutral terminal N may be defined as a second external power supply PS2. Third AC power is supplied from the third phase terminal L3 and the neutral terminal N, and between the third phase terminal L3 and the neutral terminal N may be defined as a third external power supply PS3.

The first AC power, the second AC power, and the third AC power have a phase difference of 120 degrees with respect to each other. The first external power supply PS1, the second external power supply PS2, and the third external power supply PS3 may supply the AC power independently of each other.

The cooking apparatus 100 may be supplied with the AC power from the first external power supply PS1 and the second external power supply PS2 among the first external power supply PS1, the second external power supply PS2 and the third external power supply PS3. In other words, the cooking apparatus 100 may be supplied with different AC power having different phases from the first external power supply PS1 and the second external power supply PS2.

The switching circuit 131 may selectively connect the external power supply PS to the rectifier circuit 132. Particularly, the switching circuit 131 may selectively connect the first and second external power supplies PS1 and PS2 to the first, second, third and fourth rectifiers 221, 222, 223 and 224.

For example, the switching circuit 131 may connect the first external power supply PS1 to the first and second rectifiers 221 and 222. The first external power supply PS1 may supply the AC power to the first and second rectifiers 221 and 222. The first and second rectifiers 221 and 222 may supply the DC power to the first and second inverters 231 and 232, respectively. The first and second inverters 231 and 232 may supply the drive current to the first and second coils 121 and 122. Accordingly, the first external power supply PS1 may supply the power to the first and second coils 121 and 122 arranged in the left column of the cooking plate 102.

Further, the switching circuit 131 may connect the second external power supply PS2 to the third and fourth rectifiers 223 and 224. Accordingly, the second external power supply PS2 may supply power to the third and fourth coils 123 and 124 arranged in the right column of the cooking plate 102.

Accordingly, the switching circuit 131 may connect the external power supply PS to the rectifier circuit 132 so that the first external power supply PS1 supplies the power to the first and second coils 121 and 122 and the second external power supply PS2 supplies the power to the third and fourth coils 123 and 124. Accordingly, the cooking apparatus 100 may stably supply the power to the first, second, third, and fourth coils 121, 122, 123, and 124 from the first and second external power supplies PS1 and PS2.

The switching circuit 131 may switch the connection between the external power supply PS and the rectifier circuit 132 according to the output of the coils 121, 122, 123, and 124. For example, when the first coil 121 and the second coil 122 simultaneously operate and when the output of the first coil 121 is greater than a reference output, the switching circuit 131 may connect the external power supply PS to the rectifier circuit 132 so that the first external power supply PS1 supplies the power to the first coil 121 and the second external power supply PS2 supplies the power to the second coil 122. In other words, the switching circuit 131 may connect the first external power supply PS1 to the first rectifier 221 and may connect the second external power supply PS2 to the second rectifier 222.

Therefore, although a load is concentrated on one of the plurality of coils 120, the cooking apparatus 100 may intensively supply the power from the external power supply PS to the coil where a load is concentrated, and thus the cooking apparatus 100 may increase the maximum output of the load-concentrated coil.

The controller 140 may control the operation of the driver 130 according to the user input received through the user interface 110. Particularly, the controller 140 may select at least one coil among the plurality of coils 120 based on user input, and may control the driver 130 so that the driver 130 supplies a drive current to the selected coil.

For example, the controller 140 may control the driver 130 so that the driver 130 supplies the drive current to the first coil 121 selected based on the user input, or may control the driver 130 so that the driver 130 supplies the drive current to the first and second coils 121 and 122 selected based on the user input.

The controller 140 may identify a coil overlapped with the cooking vessel 1 placed on the cooking plate 102 among the plurality of coils 120, and may control the driver 130 so that the driver 130 selectively supplies the drive current to the at least one coil overlapped with the cooking vessel 1.

For example, the controller 140 may control the driver 130 so that the driver 130 supplies the drive current to the first coil 121 identified as overlapped with the cooking vessel 1, or may control the driver 130 so that the driver 130 supplies the drive current to the first and second coils 121 and 122 identified as overlapped with the cooking vessel 1.

Further, the controller 140 may identify the coil overlapped with the cooking vessel 1 based on a change in the inductance of the coils. The inductance of the coil overlapped with the cooking vessel 1 is different from the inductance of the coil not overlapped with the cooking vessel 1 and thus a current flowing in the coil overlapped with the cooking vessel 1 is different from a current flowing in the coil not overlapped with the cooking vessel 1.

The controller 140 may control the driver 130 so that the driver 130 applies a detection voltage to the plurality of coils 120 to detect the cooking vessel 1 at a predetermined time interval. In addition, the controller 140 may detect a current flowing in the plurality of coils through a detection signal.

The controller 140 may measure current values flowing in the plurality of coils 120 and may compare the measured current values with a reference current value. At this time, the reference current value may be a current flowing in the coil not overlapped with the cooking vessel 1.

The controller 140 may identify that the coil having the current different from the reference current value is overlapped with the cooking vessel 1.

However, the disclosure is not limited thereto, and the cooking apparatus 100 may identify a coil overlapped with the cooking vessel 1 by measuring frequency, and phase of the AC flowing in the plurality of coils 120. Further, the cooking apparatus 100 may include a sensor configured to directly detect the cooking vessel 1.

The controller 140 may control the magnitude of the magnetic field and/or the electromagnetic field generated by each of the plurality of coils 120 based on the user input inputted through the user interface 110. Particularly, based on the user input, the controller 140 may control the drive current (or power) supplied to each of the plurality of coils 120.

The controller 140 may include a processor 141 and a memory 142.

The memory 142 may store control programs and control data for controlling the operation of the cooking apparatus 100. Particularly, the memory 142 may store a driving program and driving data for controlling the operation of the driver 130. The memory 142 may also store user input received from the user interface 110 and control instructions generated by the processor 141.

According to the request of the processor 141, the memory 142 may store programs and/or data, and may provide the stored programs and/or data to the processor 141. For example, the memory 142 may provide a user input to the processor 141 at the request of the processor 141.

The memory 142 may include a volatile memory such as a Static Random Access Memory (S-RAM) or a Dynamic Random Access Memory (DRAM) that can temporarily store data. In addition, the memory 142 may include a non-volatile memory such as a Read Only Memory (ROM), an Erasable Programmable Read Only Memory (EPROM), an Electrically Erasable Programmable Read Only Memory (EEPROM), or a flash memory that can store data for a long time.

The processor 141 may process data of the memory 142 according to a program provided from the memory 142 and may generate a control signal for controlling the driver 130 and the user interface 110 according to the processing result.

For example, according to a user input received from the user interface 110, the processor 141 may generate an output control signal for controlling the drive current (or power) supplied to the plurality of coils 120.

The processor 141 may include a logic operation circuit, an arithmetic operation circuit, and a memory circuit.

The memory 142 and the processor 141 may be implemented as a separate integrated circuit (IC), or the memory 142 and the processor 141 may be integrated into one integrated circuit.

As mentioned above, by using the plurality of inverters 230, the cooking apparatus 100 may control the plurality of coils 120 independently of each other. Since the plurality of inverters 230 and the plurality of rectifiers 220 correspond to each other on a one-to-one basis, the cooking apparatus 100 may supply power to the plurality of coils 120 independently of each other. By using the switching circuit 131 configured to connect the plurality of rectifiers 220 each to the first power supply PS1 or the second power supply PS2, the cooking apparatus 100 may increase the maximum power supplied to the plurality of coils 120.

Hereinafter, a configuration and an operation of the plurality of inverters 230, the plurality of rectifiers 220, and the switching circuit 131 will be described in detail.

Figure 6:
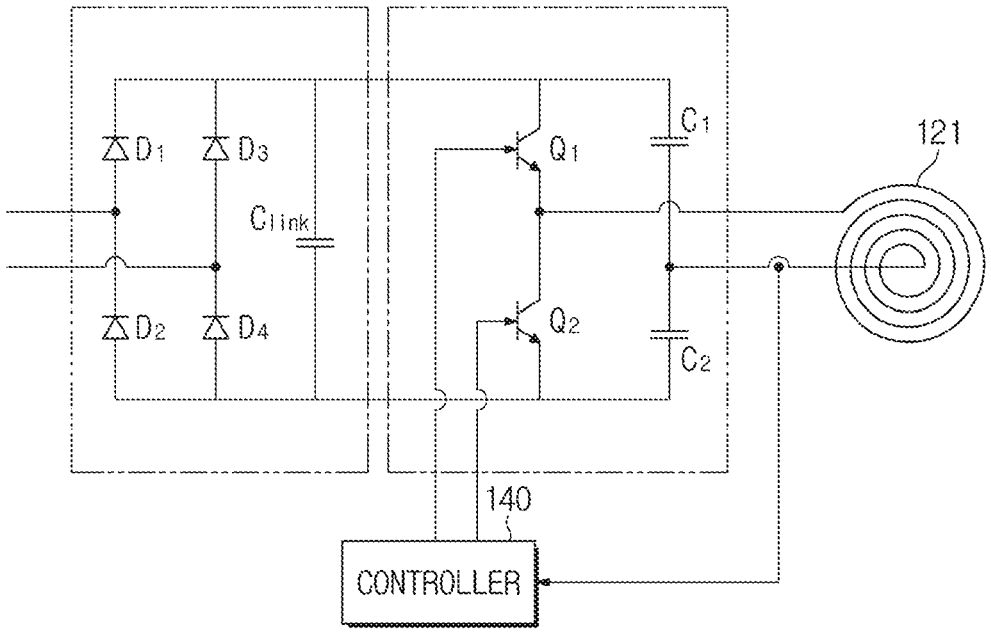
FIG. 6 is a view particularly illustrating a first rectifier, a first inverter, and a first coil shown in FIG. 5.
Figure 7:
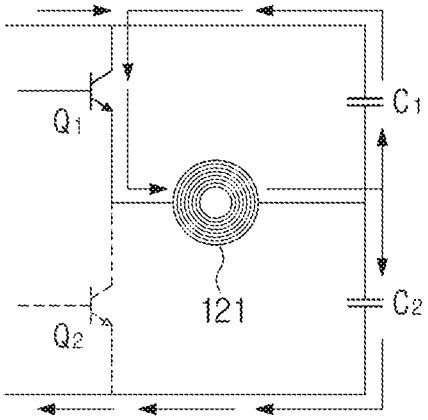
FIG. 7 is a view illustrating an example of a current flow of a first inverter and a first coil contained in the cooking apparatus according to an embodiment of the disclosure.
Figure 8:
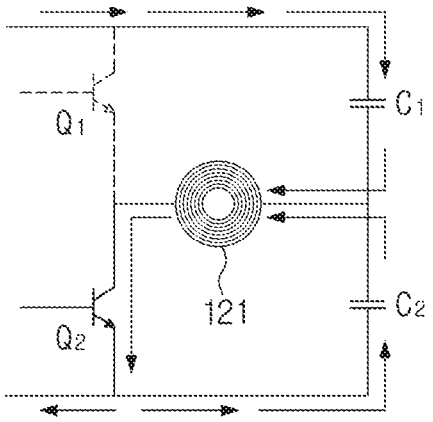
FIG. 8 is a view illustrating another example of the current flow of the first inverter and the first coil contained in the cooking apparatus according to an embodiment of the disclosure.
Figure 9:
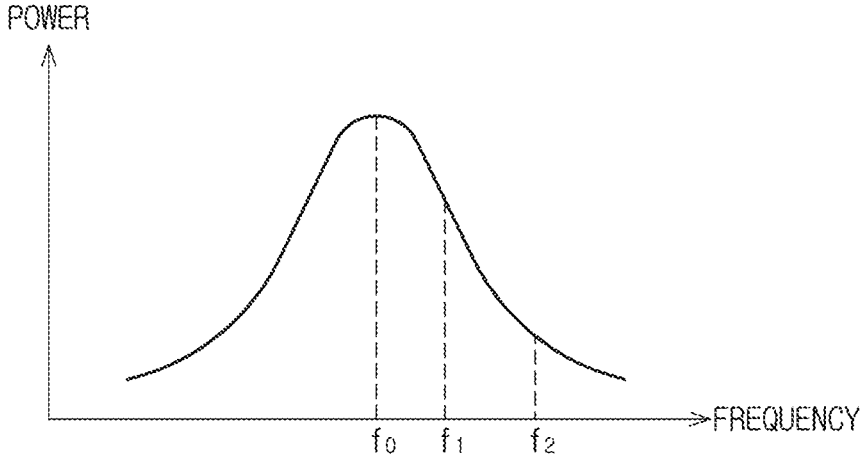
FIG. 9 is a view illustrating output of the first coil according to an operating frequency of the first inverter contained in the cooking apparatus according to an embodiment of the disclosure.

FIG. 6 is a view particularly illustrating a first rectifier, a first inverter, and a first coil shown in FIG. 5. FIG. 7 is a view illustrating an example of a current flow of a first inverter and a first coil contained in the cooking apparatus according to an embodiment of the disclosure. FIG. 8 is a view illustrating another example of the current flow of the first inverter and the first coil contained in the cooking apparatus according to an embodiment of the disclosure. FIG. 9 is a view illustrating an output of the first coil according to an operating frequency of the first inverter contained in the cooking apparatus according to an embodiment of the disclosure.

Hereinafter a configuration and an operation of the first rectifier 221 among the plurality of rectifiers 220, the first inverter 231 of the plurality of inverters 230, and the first coil 121 of the plurality of coils 120 will be described.

A configuration and an operation of the second, third and fourth rectifiers 222, 223 and 224 may be the same as those of the first rectifier 221, and a configuration and an operation of the second, third and fourth inverters 232, 233 and 234 may be the same as those of the first inverter 231.

As illustrated in FIG. 6, the first rectifier 221 may include a bridge diode which is installed between a first positive terminal P1 and a first negative terminal N1 and configured to convert an AC power to DC power. The bridge diode may convert an AC voltage having magnitude and polarity (positive voltage or negative voltage) changing in time, into a DC voltage having constant magnitude and polarity, and may convert an AC having magnitude and direction (positive current or negative current) changing in time, into a DC having constant magnitude.

For example, the bridge diode may include four diodes D1, D2, D3, and D4. The four diodes D1, D2, D3 and D4 may form a pair of diodes D1 and D2, and D3 and D4 connected in series between the first positive terminal P1 and the first negative terminal N1. The two diode pairs D1 and D2, and D3 and D4 may be connected in parallel with each other. The bridge diode may convert an AC voltage having a polarity changing in time, into a positive voltage having a constant polarity and convert an AC having a direction changing in time, into a positive current having a constant direction.

In addition, the first rectifier 221 may include a DC link capacitor (clink). Opposite ends of the DC link capacitor (clink) may be connected to the first positive terminal P1 and the first negative terminal N1, respectively, and the DC link capacitor (clink) may convert a positive voltage having a magnitude changing in time, into a DC voltage having a constant magnitude.

The first inverter 231 may include a first inverter switch Q1 and a second inverter switch Q2, and a first resonant capacitor C1 and a second resonant capacitor C2. The first inverter switch Q1 and the second inverter switch Q2 allow or block the supply of drive current to the first coil 121. The first resonant capacitor C1 and the second resonant capacitor C2 resonate with the first coil 121.

One end of the first inverter switch Q1 may be connected to the first positive terminal P1 and one end of the second inverter switch Q2 is connected to the first negative terminal N1. The other end of the first inverter switch Q1 may be connected to the other end of the second inverter switch Q2. In other words, the first inverter switch Q1 and the second inverter switch Q2 may be connected in series between the first positive terminal P1 and the first negative terminal N1.

The first inverter switch Q1 and the second inverter switch Q2 may include a three terminal semiconductor switch configured to be turned on/off at a high speed of 20 kilohertz (kHz) to 70 kHz and configured to have a high response speed. For example, the first inverter switch Q1 and the second inverter switch Q2 may include a bipolar junction transistor (BJT), a metal-oxide-semiconductor field effect transistor (MOSFET), an insulated gate bipolar transistor (IGBT), or a thyristor.

One end of the first resonant capacitor C1 may be connected to the first positive terminal P1 and one end of the second resonant capacitor C2 may be connected to the first negative terminal N1. The other end of the first resonant capacitor C1 may be connected to the other end of the second resonant capacitor C2. In other words, the first resonant capacitor C1 and the second resonant capacitor C2 may be connected in series between the first positive terminal P1 and the first negative terminal N1.

The first inverter switch Q1 and the second inverter switch Q2 may be turned on/off by a control signal of the controller 140. Further, depending on the turn-on/off of the first inverter switch Q1 and the second inverter switch Q2, a current may flow from the first resonant capacitor C1 and/or the second resonant capacitor C2 to the first coil 121 or a current may flow from the first coil 121 to the first resonant capacitor C1 and/or the second resonant capacitor C2.

As mentioned above, the magnitude and direction of the current flowing through the first coil 121 may change depending on the turn-on/off of the first inverter switch Q1 and the second inverter switch Q2 contained in the first inverter 231. In other words, an AC may be supplied from the first inverter 231 to the first coil 121.

For example, when the first inverter switch Q1 is closed (turned on) and the second inverter switch Q2 is opened (turned off) as illustrated in FIG. 7, the current may flow from the first rectifier 221 to the first coil 121 through the first inverter Q1. In addition, the current flows to the second resonant capacitor C2 through the first coil 121, the electric energy is stored in the second resonant capacitor C2, and the voltage of the second resonant capacitor C2 is increased. At this time, a positive current (a current flowing from the left side to the right side of the induction heating coil in FIG. 7) may flow in the first coil 121. In addition, due to the increase in the voltage of the second resonant capacitor C2, the current may flow from the first resonant capacitor C1 to the first coil 121.

Further, when the first inverter switch Q1 is opened (turned off) and the second inverter switch Q2 is closed (turned on) as illustrated in FIG. 8, the current may flow from the second resonant capacitor C4 to the first coil 121. A current flowing in the first coil 121 may flow to the first rectifier 221 through the first coil 121. At this time, a negative current (a current flowing from the right side to the left side of the induction heating coil in FIG. 8) may flow in the first coil 121. Because the current is output from the second resonant capacitor C2, the voltage of the second resonant capacitor C2 may be reduced and the current may flow from the rectifier circuit 132 to the first coil 121 through the first resonant capacitor C1.

Accordingly, the resonance may be generated between the first coil 121 and the first and second resonant capacitors C1 and C2 according to opening and closing of the first and second inverter switches Q1 and Q2. Due to the resonance between the first coil 121 and the first and second resonant capacitors C1 and C2, the AC may flow in the first coil 121.

The drive current (power) supplied to the first coil 121 may vary according to the turn-on/off frequency (switching frequency) of the first and second inverter switches Q1 and Q2. Therefore, a magnitude of the magnetic field B generated by the first coil 121 may vary according to the switching frequency of the first and second inverter switches Q1 and Q2.

For example, the power supplied to the first coil 121 may be maximized when the switching frequency of the first and second inverter switches Q1 and Q2 is identical to a resonance frequency f0 between the first coil 121 and the first and second resonant capacitors C1 and C2.

When the switching frequency of the first and second inverter switches Q1 and Q2 is greater than the resonance frequency f0, the power supplied to the first coil 121 may decrease as the switching frequency increases. As illustrated in FIG. 9, power, which is supplied to the first coil 121 when the first and second inverter switches Q1 and Q2 are switched with a first frequency f1 greater than the resonance frequency f0, may be greater than power, which is supplied to the first coil 121 when the first and second inverter switches Q1 and Q2 are switched with a second frequency f2 greater than the first frequency f1.

In addition, when the switching frequency of the first and second inverter switches Q1 and Q2 is greater than the resonance frequency f0, the magnitude of the magnetic field B generated by the first coil 121 may decrease as the switching frequency increases.

When the switching frequency of the first and second inverter switches Q1 and Q2 is less than the resonance frequency f0, the power supplied to the first coil 121 may decrease as the switching frequency decreases. In addition, when the switching frequency of the first and second inverter switches Q1 and Q2 is less than the resonance frequency f0, the magnitude of the magnetic field B generated by the first coil 121 may decrease as the switching frequency decreases.

As mentioned above, by the switching of the first and second inverter switches Q1 and Q2 contained in the first inverter 231, the AC power may be supplied to the first coil 121, and the first coil 121 may generate the magnetic field B. The magnitude of the magnetic field B generated by the first coil 121 may vary according to the switching frequency of the first and second inverter switches Q1 and Q2. When the switching frequency of the first and second inverter switches Q1 and Q2 is greater than the resonance frequency, the magnitude of the magnetic field B generated by the first coil 121 may decrease as the switching frequency increases.

Figure 10:
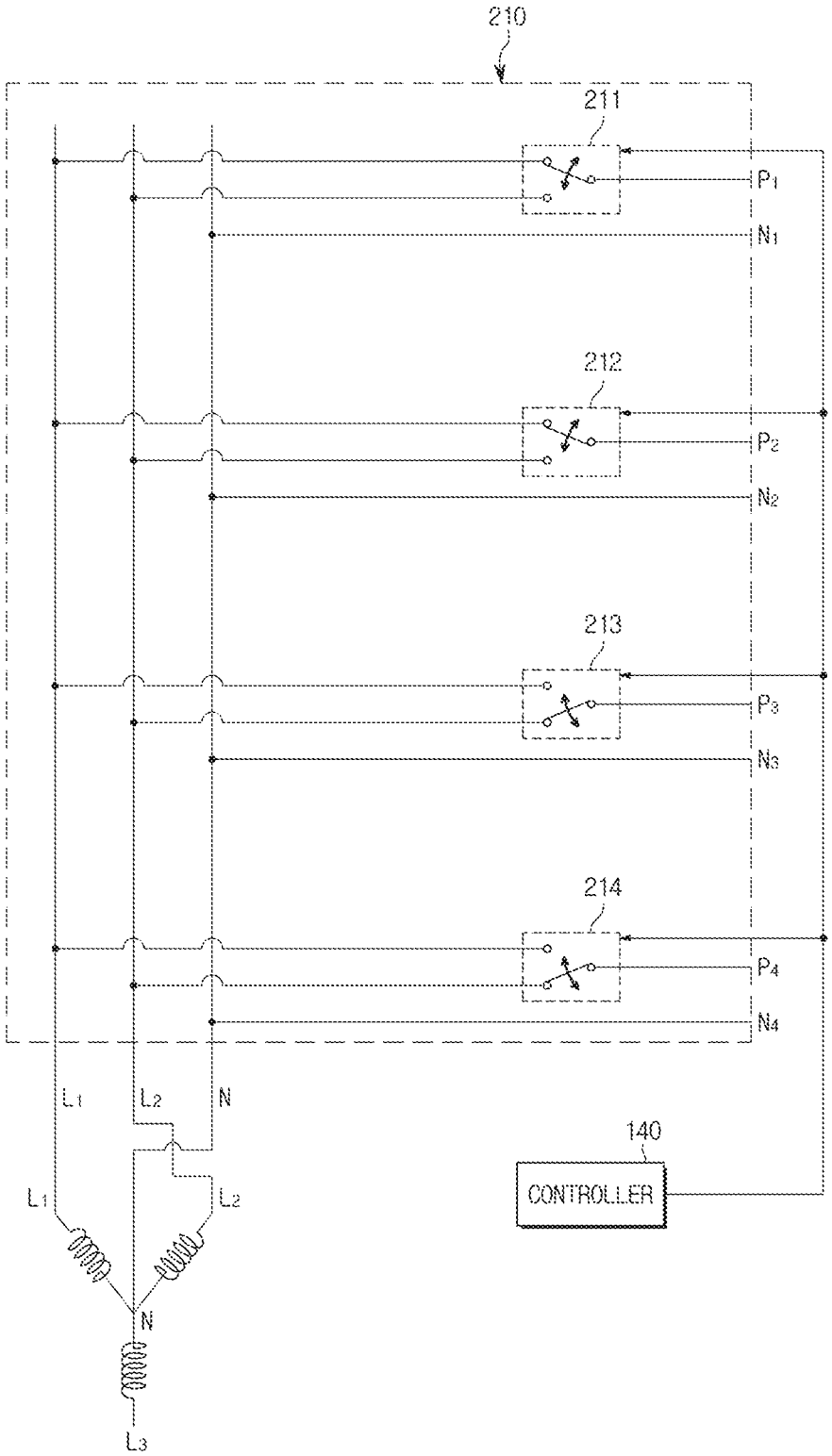
FIG. 10 illustrates a view of an example of a switching circuit contained in the cooking apparatus according to an embodiment of the disclosure.

FIG. 10 illustrates a view of an example of a switching circuit contained in the cooking apparatus according to an embodiment of the disclosure.

The external power supply PS may include the first external power supply PS1 and the second external power supply PS2 for supplying AC power having different phases to the cooking apparatus 100.

The switching circuit 131 may selectively connect the external power supply PS to the rectifier circuit 132. Particularly, the switching circuit 131 may selectively connect the first, second, third, and fourth rectifiers 221, 222, 223, and 224 to the first external power supply PS1 or the second external power supply PS2. For example, the switching circuit 131 may connect the first and second rectifiers 221 and 222 to the first external power supply PS1 and may connect the third and fourth rectifiers 223 and 224 to the second external power supply PS2.

The switching circuit 131 may be connected to the first and second external power supplies PS1 and PS2. More particularly, the switching circuit 131 may be connected to the first external power supply PS1 through the first phase terminal L1 and the neutral terminal N of the external power supply PS. The switching circuit 131 may be connected to the second external power supply PS2 through the second phase terminal L2 and the neutral terminal N of the external power supply PS. The first external power supply PS1 and the second external power supply PS2 may supply the AC power having different phases to the cooking apparatus 100.

Further, the switching circuit 131 may be connected to the first, second, third and fourth rectifiers 221, 222, 223, and 224. Particularly, the switching circuit 131 may be connected to the first rectifier 221 through the first positive terminal P1 and the first negative terminal N1. The switching circuit 131 may be connected to the second rectifier 222 through the second positive terminal P2 and the second negative terminal N2. The switching circuit 131 may be connected to the third rectifier 223 through the third positive terminal P3 and the third negative terminal N3. The switching circuit 131 may be connected to the fourth rectifier 224 through the fourth positive terminal P4 and the fourth negative terminal N4.

The first, second, third and fourth negative terminals N1, N2, N3 and N4 may be connected to the neutral terminal N of the external power supply PS.

The switching circuit 131 may include a plurality of switch modules 210: 211, 212, 213, and 214 configured to selectively connect each of the first, second, third and fourth positive terminals P1, P2, P3 and P4 to the first phase terminal L1 or the second phase terminal L2.

The plurality of switch modules 210 may include a first switch module 211 connected to the first positive terminal P1, a second switch module 212 connected to the second positive terminal P2, a third switch module 213 connected to the third positive terminal P3, and a fourth switch module 214 connected to the fourth positive terminal P4.

The first, second, third and fourth switch modules 211, 212, 213 and 214 may connect each of the first, second, third and fourth positive terminals P1, P2, P3 and P4 to the first phase terminal L1 or the second phase terminal L2 according to a control signal of the controller 140. The first switch module 211 may connect the first positive terminal P1 to the first phase terminal L1 or the second phase terminal L2. The second switch module 212 may connect the second positive terminal P2 to the first phase terminal L1 or the second phase terminal L2. The third switch module 213 may connect the third positive terminal P3 to the first phase terminal L1 or the second phase terminal L2. The fourth switch module 214 may connect the fourth positive terminal P4 to the first phase terminal L1 or the second phase terminal L2.

For example, the controller 140 may control the first and second switch modules 211 and 212 so that the first and second positive terminals P1 and P2 are connected to the first phase terminal L1, respectively. The controller 140 may control the third and fourth switch modules 213 and 214 so that the third and fourth positive terminals P3 and P4 are connected to the second phase terminal L2, respectively.

Accordingly, the power may be evenly supplied to the first, second, third, and fourth coils 121, 122, 123, and 124 from the first and second external power supplies PS1 and PS2.

Further, the first and second coils 121 and 122 arranged in the left column may operate as two or one burner depending on a user input. For example, when a separate cooking vessel 1 is placed in the first and second coils 121 and 122 or when a user inputs an independent command for the first and second coils 121 and 122, the first and second coils 121 and 122 may operate as two burners. Alternatively, when a single vessel 1 is placed across the first and second coils 121 and 122 or when a user inputs a command for integrally operating the first and second coils 121 and 122, the first and second coils 121 and 122 may operate as a single burner. The third and fourth coils 123 and 124 arranged in the right column may also operate as two or one burner depending on a user input.

According to the output of the coils 121, 122, 123 and 124, the controller 140 may switch a connection between the first, second, third and fourth positive terminals P1, P2, P3 and P4 and the first and second phase terminal L1 and L2. For example, when the first coil 121 and the second coil 122 operate simultaneously and a sum of the output of the first coil 121 and the output of the second coil 122 is greater than the reference output, the controller 140 may control the first switch module 211 so that the first positive terminal P1 is connected to the first phase terminal L1, and the controller 140 may control the second switch module 212 so that the second positive terminal P2 is connected to the second phase terminal L2. The controller 140 may control the third and fourth switch modules 213 and 214 in the same manner.

Accordingly, it is possible to increase the maximum output of the coil in which the load is concentrated, among the plurality of coils 120. For example, when the load is concentrated on the first and second coils 121 and 122, the controller 140 may supply the power from each of the first and second power supplies PS1 and PS2 to a corresponding one of the first and second coils 121 and 122, respectively.

The first, second, third and fourth switch modules 211, 212, 213 and 214 may each include a three-contact relay.

Figure 11:
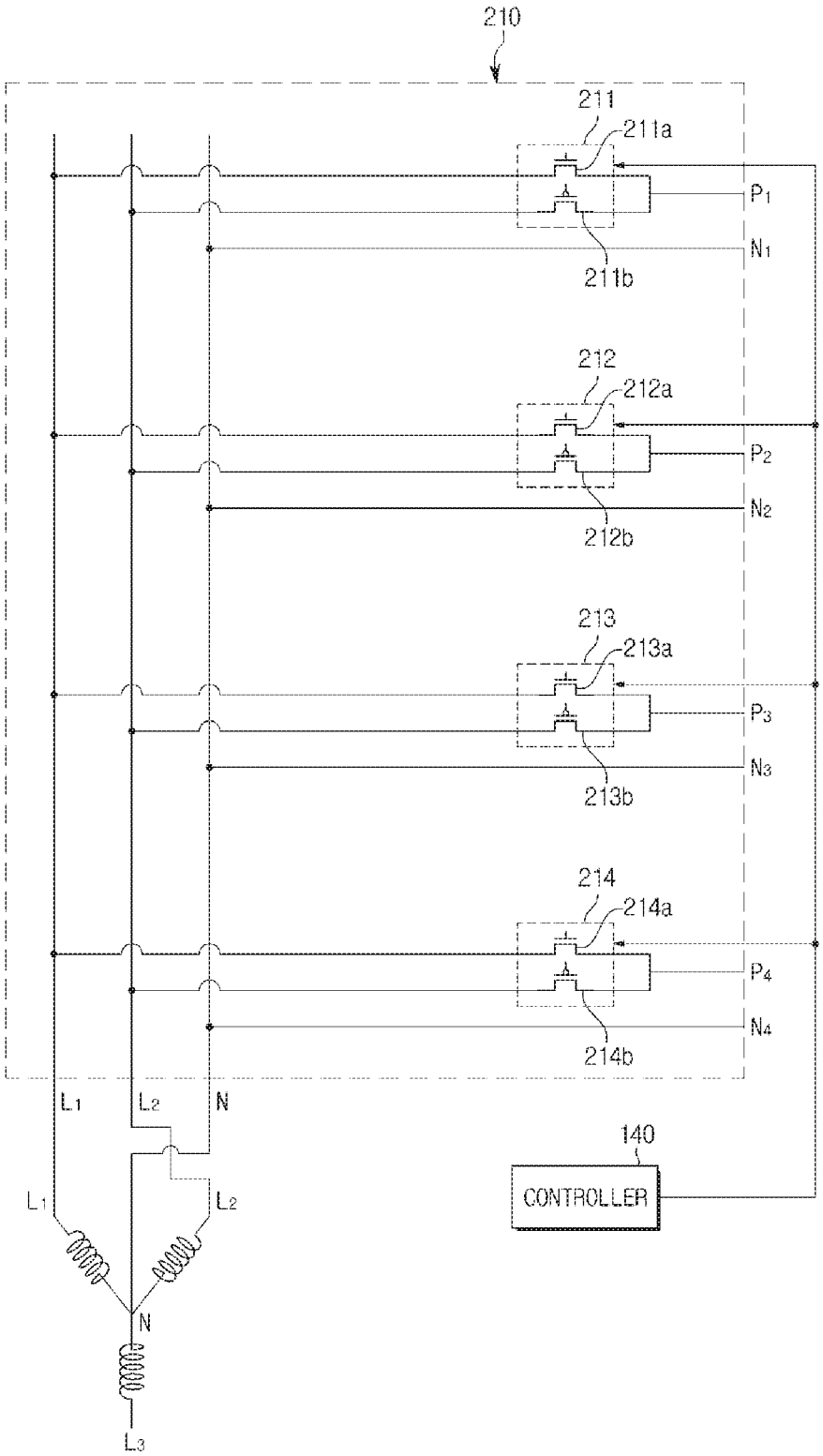
FIG. 11 illustrates a view of another example of the switching circuit contained in the cooking apparatus according to an embodiment of the disclosure.

FIG. 11 illustrates a view of another example of the switching circuit contained in the cooking apparatus according to an embodiment of the disclosure.

As illustrated in FIG. 11, the plurality of switch modules 211, 212, 213 and 214 may include positive switches 211*a*, 212*a*, 213*a*, and 214*a*, and negative switches 211*b*, 212*b*, 213*b*, and 214*b*, respectively. The positive switches 211*a*, 212*a*, 213*a* and 214*a* may be connected to the first phase terminal L1 and the negative switches 211*b*, 212*b*, 213*b* and 214*b* may be connected to the second phase terminal L2.

The positive switches 211*a*, 212*a*, 213*a*, and 214*a* and the negative switches 211*b*, 212*b*, 213*b*, and 214*b* may operate in opposite states. For example, while the positive switches 211*a*, 212*a*, 213*a* and 214*a* are turned on, the negative switches 211*b*, 212*b*, 213*b* and 214*b* may be turned off. Further, while the positive switches 211*a*, 212*a*, 213*a* and 214*a* are turned off, the negative switches 211*b*, 212*b*, 213*b* and 214*b* may be turned on.

The positive switches 211*a*, 212*a*, 213*a* and 214*a* and the negative switches 211*b*, 212*b*, 213*b* and 214*b* may employ a bipolar junction transistor (BJT), a metal-oxide-semiconductor field effect transistor (MOSFET), an insulated gate bipolar transistor (IGBT), or a thyristor.

Figure 12:
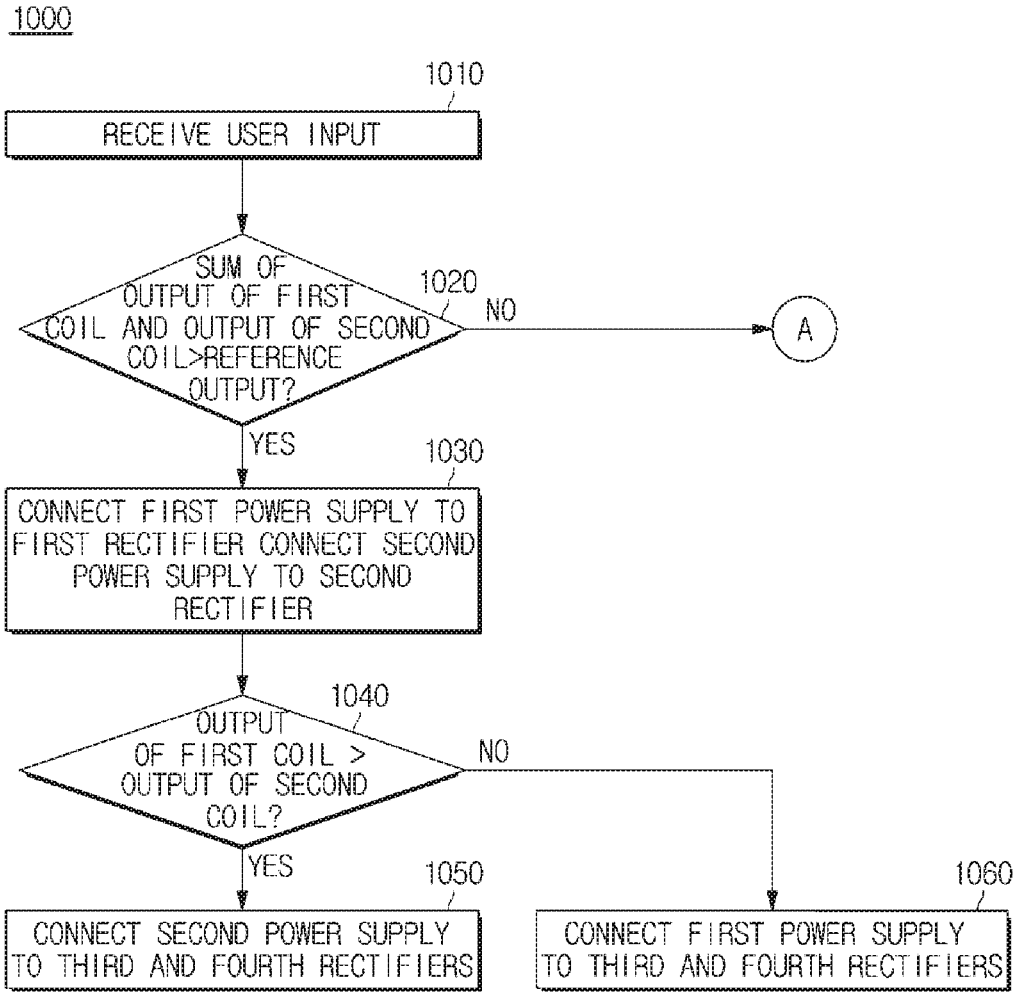
FIG. 12 illustrates a view of operations of power distribution of the cooking apparatus according to an embodiment of the disclosure.
Figure 13:
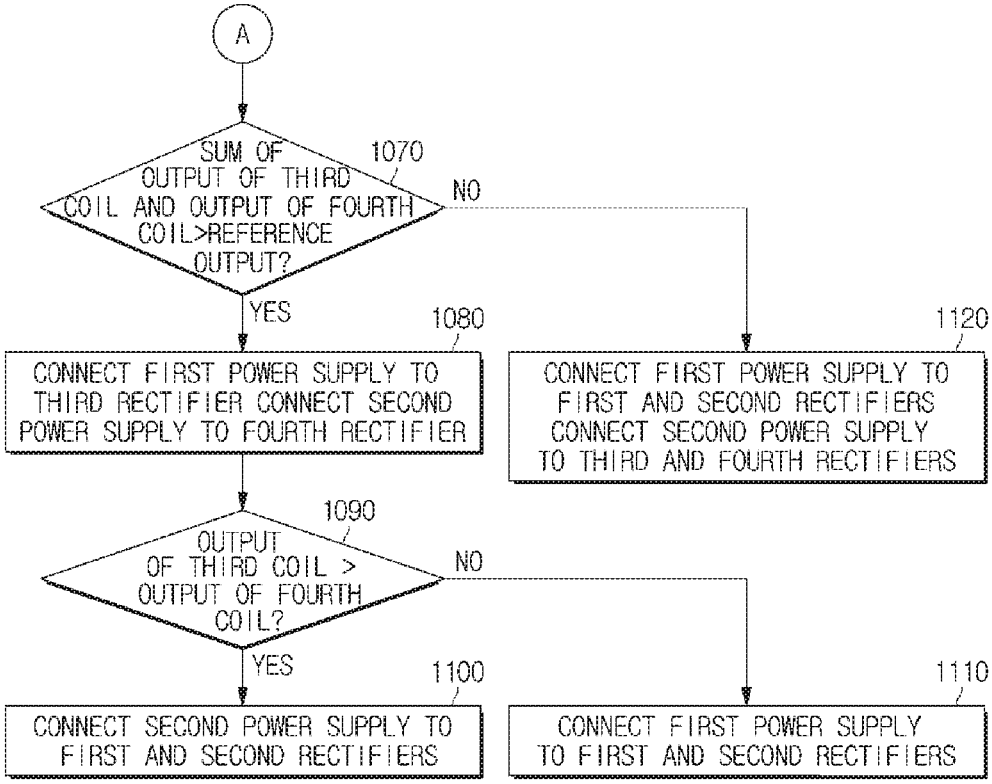
FIG. 13 illustrates a view of other operations of the power distribution of the cooking apparatus according to an embodiment of the disclosure.
Figure 14:
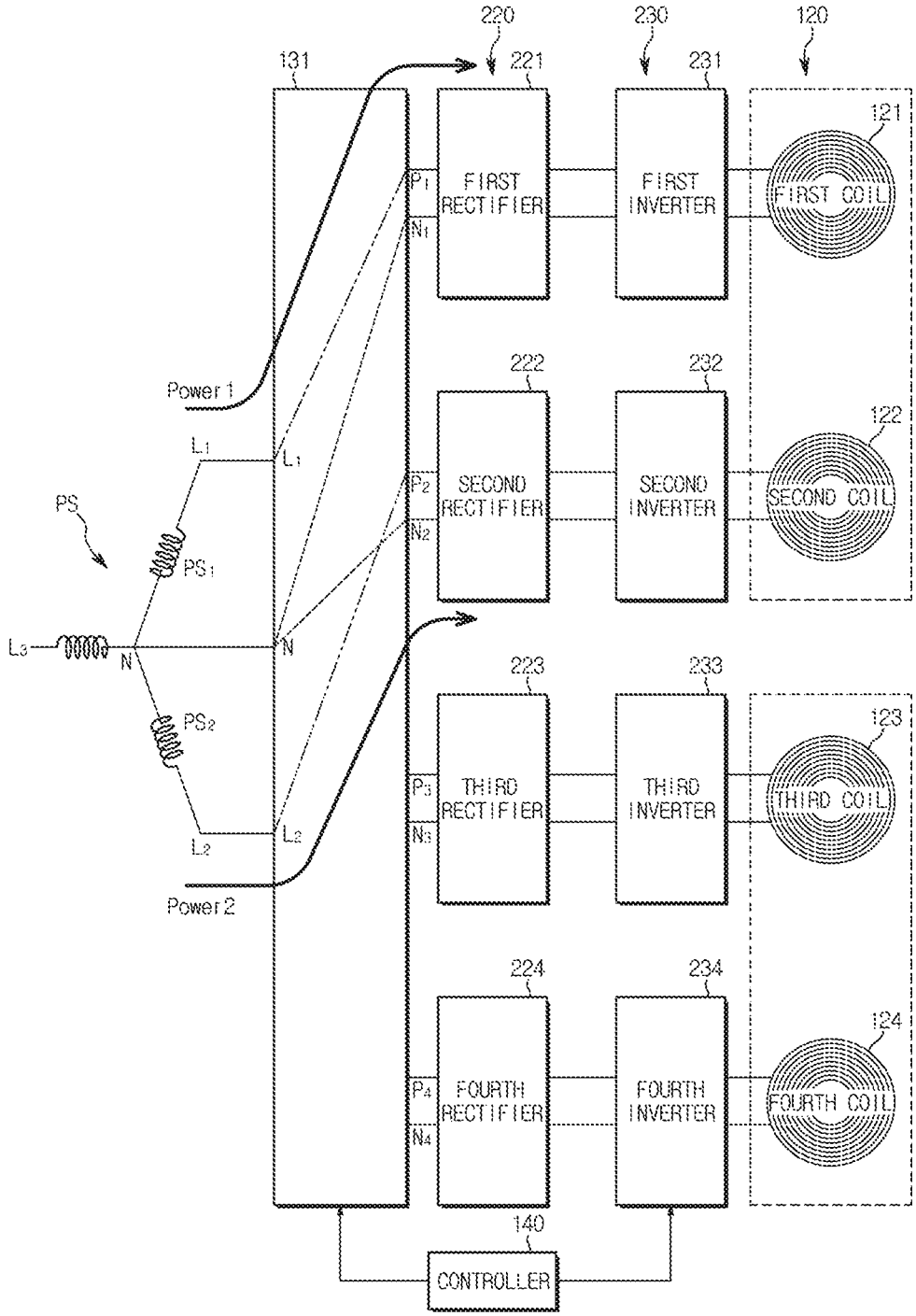
FIG. 14 is a view illustrating an example of power supply to a plurality of coils according to the operation of the power distribution of FIGS. 12 and 13.
Figure 15:
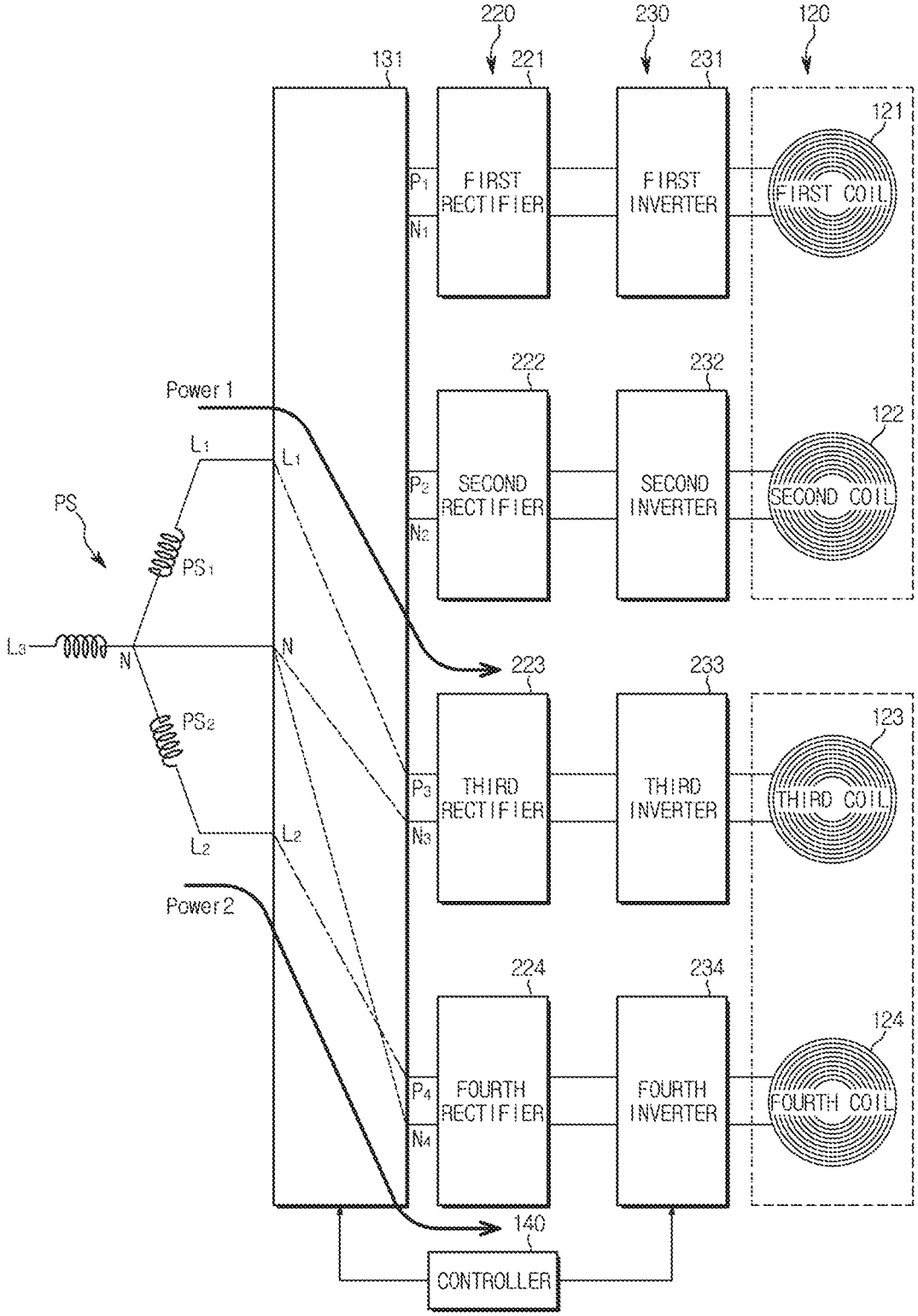
FIG. 15 is a view illustrating another example of the power supply to the plurality of coils according to the operation of the power distribution of FIGS. 12 and 13.

FIG. 12 illustrates a view of operations of power distribution of the cooking apparatus according to an embodiment of the disclosure. FIG. 13 illustrates a view of other operations of the power distribution of the cooking apparatus according to an embodiment of the disclosure. FIG. 14 is a view illustrating an example of power supply to a plurality of coils according to the operation of the power distribution of FIGS. 12 and 13. FIG. 15 is a view illustrating another example of the power supply to the plurality of coils according to the operation of the power distribution of FIGS. 12 and 13.

Power distribution (1000) of the cooking apparatus 100 will be described with reference to FIGS. 12 to 15.

The cooking apparatus 100 receives a user input from a user (1010).

The cooking apparatus 100 may receive information (or a command) on an output level from the user.

The user input 111 may include a button indicating output levels (for example, "level 1", and "level 2") that the user can input, and may include a button for increasing an output level (an output up button) or a button for decreasing an output level (an output down button).

The user may input the output level to the cooking apparatus 100 through the user interface 110. For example, the output level may indicate the magnitude of the magnetic field (or the output power of the cooking apparatus) output by the plurality of coils 120 of the cooking apparatus 100.

The output level input by the user may not be an absolute value of the output power of the cooking apparatus 100, and the output level may be a relative value representative of the output power of the cooking apparatus 100. For example, as for the output power of the cooking apparatus 100, "level 2" may be defined as greater than "level 1".

The user interface 110 may output an electrical signal corresponding to an output level input by a user, to the controller 140.

Based on the output level input by the user, the controller 140 of the cooking apparatus 100 may identify the magnitude of the magnetic field output by the plurality of coils 120 (or the output power of the cooking apparatus). The memory 142 of the controller 140 may store a lookup table including the output level of the user and the output power of the cooking apparatus 100 corresponding to the output level.

By using the lookup table, the controller 140 may identify the output power of the cooking apparatus 100 based on the output level input by the user. For example, the controller 140 may control the driver 130 so that the plurality of coils 120 outputs the magnetic field corresponding to the power of 100 watt (W) in response to the input of "level 1", and the controller 140 may control the driver 130 so that the plurality of coils 120 outputs the magnetic field corresponding to the power of 200 watt (W) in response to the input of "level 2".

The cooking apparatus 100 identifies whether the sum of the power of the first coil 121 and the second coil 122 is greater than the reference power (1020).

The controller 140 may identify required power of the first coil and required power of the second coil 122 based on the user input that is input through the user interface 110, and the controller 140 may compare a sum of the required power of the first coil and the required power of the second coil 122 with the reference power.

At this time, the reference power may be defined as power that can be supplied from the external power supplies PS1 and PS2. For example, when the first external power supply PS1 and the second external power supply PS2 each is capable of supplying 3.5 kW (for example, rated voltage: 220 V and maximum current: 16 A), the reference power may be set to 3.5 kW.

When the sum of the power of the first coil 121 and the power of the second coil 122 is greater than the reference power (yes in 1020), the cooking apparatus 100 connects the first rectifier 221 to the first external power supply PS1 and connects the second rectifier 222 to the second external power supply PS2 (1030).

When the first and second coils 121 and 122 are supplied with power from the first external power supply PS1 and when the sum of the required power of the first coil 121 and the required power of the second coil 122 is greater than the reference power, the first coil 121 and the second coil 122 may fail to generate the magnetic field B having the magnitude required by the user.

In order to prevent this, the controller 140 may connect the first coil 121 to the first external power supply PS1 and may connect the second coil 122 to the second external power supply PS2. For example, as illustrated in FIG. 14, the controller 140 may control the first switch module 211 so that the first positive terminal P1 is connected to the first phase terminal L1 and the controller 140 may control the second switch module 212 so that the second positive terminal P2 is connected to the second phase terminal L2.

Accordingly, the first coil 121 and the second coil 122 may be supplied with power from the first external power supply PS1 and the second external power supply PS2, respectively. Further, the first coil 121 and the second coil 122 may be supplied with the maximum power from the first external power supply PS1 and the second external power supply PS2, respectively, and thus the maximum magnitude of the magnetic field B generated by the first coil 121 and the second coil 122 may be increased.

The cooking apparatus 100 identifies whether the power of the first coil 121 is greater than the power of the second coil 122 (1040).

The controller 140 may identify the required power of the first coil 121 and the requested power of the second coil 122 and may compare the required power of the first coil 121 with the required power of the second coil 122.

When the power of the first coil 121 is greater than the power of the second coil 122 (yes in 1040), the cooking apparatus 100 connects the third and fourth rectifiers 223 and 224 to the second external power supply PS2 (1050).

Because the controller 140 connects the first rectifier 221 and the second rectifier 222 to the first external power supply PS1 and the second external power supply PS2, respectively, the third rectifier 223 and the fourth rectifier 224 may be disconnected from the external power supply PS.

The controller 140 may control the switching circuit 131 so that any one of the first external power supply PS1 or the second external power supply PS2 supplies power to the third coil 123 and the fourth coil 124, thereby allowing a user to use the third coil 123 and the fourth coil 124. Particularly, the controller 140 may control the switching circuit 131 so that a power supply, which is connected to any one requiring less power between the first coil 121 and the second coil 122, supplies power to the third coil 123 and the fourth coil 124, and thereby the power is stably supplied to the first coil 121 and the second coil 122.

Particularly, when required power of the second coil 122 is less than required power of the first coil 121, the controller 140 may control the switching circuit 131 so that the second external power supply PS2 connected to the second coil 122 supplies power to the third coil 123 and the fourth coil 124. For example, the controller 140 may control the third switch module 213 so that the third positive terminal P3 is connected to the second phase terminal L2 and may control the fourth switch module 214 so that the fourth positive terminal P4 is connected to the second phase terminal L2.

When the power of the first coil 121 is not greater than the power of the second coil 122 (no in 1040), the cooking apparatus 100 may connect the third and fourth rectifiers 223 and 224 to the first external power supply PS1 (1060).

When the required power of the first coil 121 is less than the required power of the second coil 122, the controller 140 may control the switching circuit 131 so that the first external power supply PS1 connected to the first coil 121 supplies power to the third coil 123 and the fourth coil 124. For example, the controller 140 may control the third switch module 213 so that the third positive terminal P3 is connected to the first phase terminal L1 and may control the fourth switch module 214 so that the fourth positive terminal P4 is connected to the first phase terminal L1.

As mentioned above, when the sum of the required power of the first coil 121 and the required power of the second coil 122 exceeds the reference power (the maximum power of the external power supply), the cooking apparatus 100 may supply power from the first external power supply PS1 and the second external power supply PS2 to the first coil 121 and the second coil 122, respectively. Therefore, a maximum output of the first coil 121 and a maximum output of the second coil 122 may be increased to a maximum power supply of the first external power supply PS1 and a maximum power supply of the second external power supply PS2, respectively.

When the sum of the power of the first coil 121 and the power of the second coil 122 is not greater than the reference power (no in 1020), the cooking apparatus 100 identifies whether the sum of the power of the third coil 123 and the power of the fourth coil 124 is greater than the reference power (1070).

The controller 140 may identify required power of the third coil 123 and required power of the fourth coil 124 based on the user input that is input through the user interface 110, and the controller 140 may compare a sum of the required power of the third coil 123 and the required power of the fourth coil 124 with the reference power.

When the sum of the power of the third coil 123 and the power of the fourth coil 124 is greater than the reference power (yes in 1070), the cooking apparatus 100 connects the third rectifier 223 to the first external power supply PS1 and connects the fourth rectifier 224 to the second external power supply PS2 (1080).

When the third and fourth coils 123 and 123 are supplied with power from the second external power supply PS2 and when the sum of the required power of the third coil 123 and the required power of the fourth coil 124 is greater than the reference power, the third coil 123 and the fourth coil 124 may fail to generate the magnetic field B having the magnitude required by the user.

In order to prevent this, the controller 140 may connect the third coil 123 to the first external power supply PS1 and may connect the fourth coil 124 to the second external power supply PS2. For example, as illustrated in FIG. 15, the controller 140 may control the third switch module 213 so that the third positive terminal P3 is connected to the first phase terminal L1 and the controller 140 may control the fourth switch module 214 so that the fourth positive terminal P4 is connected to the second phase terminal L2.

Accordingly, the third coil 123 and the fourth coil 124 may be supplied with power from the first external power supply PS1 and the second external power supply PS2, respectively. Further, the third coil 123 and the fourth coil 124 may be supplied with the maximum power from the first external power supply PS1 and the second external power supply PS2, respectively, and thus the maximum magnitude of the magnetic field B generated by the third coil 123 and the fourth coil 124 may be increased.

The cooking apparatus 100 identifies whether the power of the third coil 123 is greater than the power of the fourth coil 124 (1090).

When the power of the third coil 123 is greater than the power of the fourth coil 124 (yes in 1090), the cooking apparatus 100 connects the first and second rectifiers 221 and 222 to the second external power supply PS2 (1100).

In the operation 1100, the controller 140 may control the first switch module 211 so that the first positive terminal P1 is connected to the first phase terminal L1 and the controller 140 may control the second switch module 212 so that the second positive terminal P2 is connected to the second phase terminal L2 in the same manner as that of the operation 1050.

When the power of the third coil 123 is not greater than the power of the fourth coil 124 (no in 1090), the cooking apparatus 100 may connect the first and second rectifiers 221 and 222 to the first external power supply PS1 (1110).

In the operation 1110, the controller 140 may control the first switch module 211 so that the first positive terminal P1 is connected to the first phase terminal L1 and the controller 140 may control the second switch module 212 so that the second positive terminal P2 is connected to the first phase terminal L1 in the same manner as that of the operation 1060.

When the sum of the power of the third coil 123 and the power of the fourth coil 124 is not greater than the reference power (no in 1070), the cooking apparatus 100 may connect the first and second rectifiers 221 and 222 to the first external power supply PS1 and may connect the third and fourth rectifiers 223 and 224 to the second external power supply PS2 (1120).

In order to stably supply power to the first, second, third, and fourth coils 121, 122, 123, and 124 from the first and second external power supplies PS1 and PS2, the cooking apparatus 100 may evenly distribute the first and second external power supplies PS1 and PS2 to the first, second, third, and fourth coils 121, 122, 123 and 124. The cooking apparatus 100 may supply power from the first external power supply PS1 to the first and second coils 121 and 122 located in the left column of the cooking plate 102, and may supply power from the second external power supply PS2 to the third and fourth coils 123 and 124 located in the right column of the cooking plate 102.

For example, the controller 140 may control the first and second switch modules 211 and 212 so that the first and second positive terminals P1 and P2 are connected to the first phase terminal L1, and the controller 140 may control the third and fourth switch modules 213 and 214 so that the third and fourth positive terminals P3 and P4 are connected to the second phase terminal L2.

As mentioned above, the cooking apparatus 100 may stably supply power to the first and second coils 121 and 122 and the third and fourth coils 123 and 124 by supplying power to the first and second coils 121 and 122 from the first external power supply PS1 and by supplying power to the third and fourth coils 123 and 124 from the second external power supply PS2.

Further, when the sum of the required power of the first coil 121 and the requested power of the second coil 122 is greater than the reference power (the maximum power that can be supplied by the external power supply), the cooking apparatus 100 may supply the power from the first external power supply PS1 to the first coil 121 and supply the power from the second external power supply PS2 to the second coil 122, thereby increasing the maximum output of the first and second coils 121 and 122. The cooking apparatus 100 may increase the maximum power of the third and fourth coils 123 and 124 in the same manner.

Figure 16:
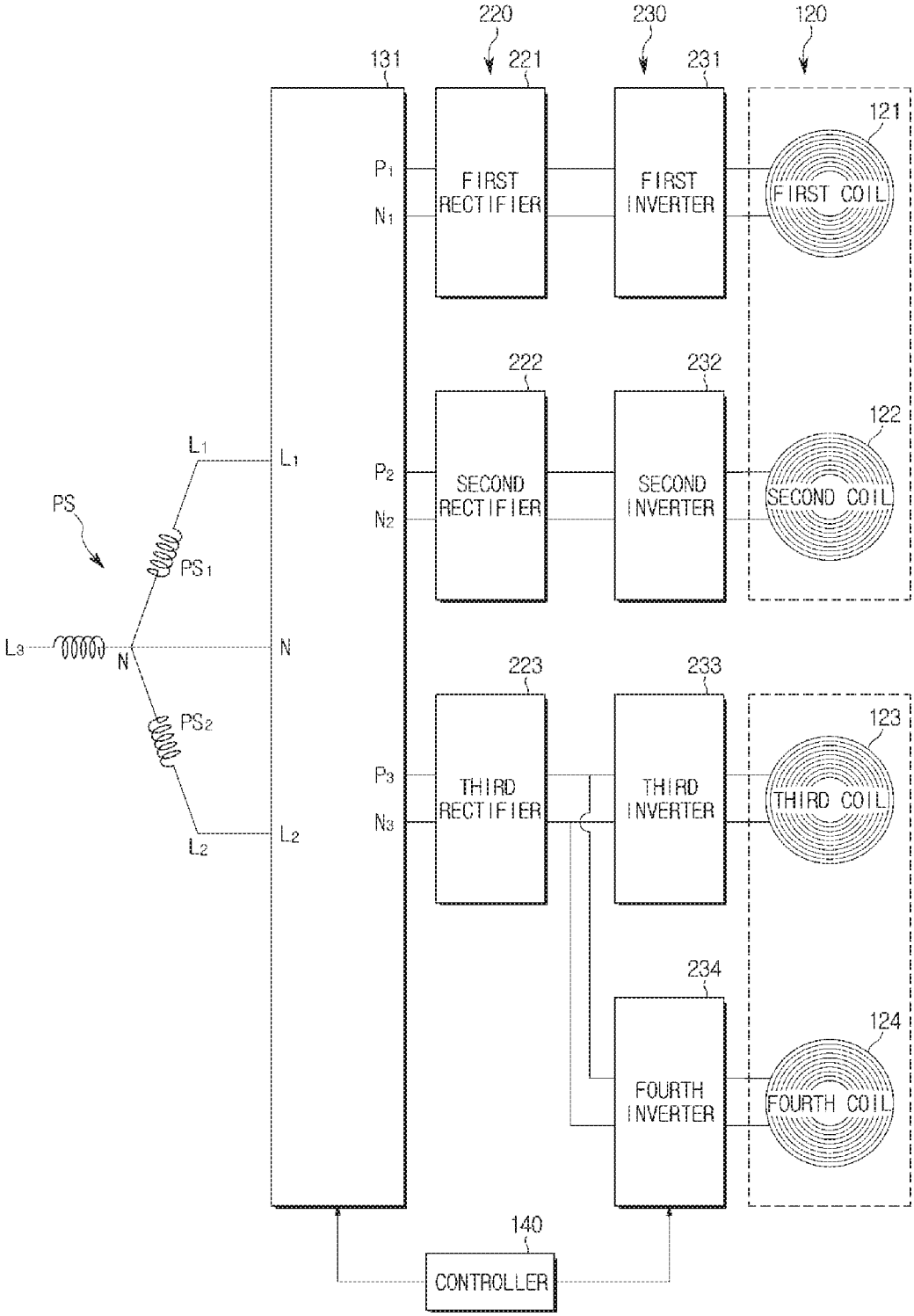
FIG. 16 illustrates a view of another example of the driver contained in the cooking apparatus according to an embodiment of the disclosure.

FIG. 16 illustrates a view of another example of the driver contained in the cooking apparatus according to an embodiment of the disclosure.

As illustrated in FIG. 16, the driver 130 includes a plurality of inverters 230, a plurality of rectifiers 220, and a switching circuit 131. The external power supply PS includes a first external power supply PS1 and a second external power supply PS2 for supplying AC power having different phases.

The plurality of inverters 230 may include first, second, third, and fourth inverters 231, 232, 233, and 234 supplying a drive current to first, second, third, and fourth coils 121, 122, 123 and 124, respectively.

The plurality of rectifiers 220 may include a first rectifier 221 supplying DC power to the first inverter 231, a second rectifier 222 supplying DC power to the second inverter 232, and a third rectifier 223 supplying DC power to the third and fourth inverters 233 and 234.

As mentioned above, the first rectifier 221 and the first inverter 231 may be connected on a one-to-one basis. Therefore, the cooking apparatus 100 may supply the maximum power from the first external power supply PS1 and the second external power supply PS2 to the first inverter 231 and the second inverter 232, respectively.

The third rectifier 223 may supply DC power to the third and fourth inverters 233 and 234, and the third and fourth coils 123 and 124 receiving the drive current from the third and fourth inverters 233 and 234 may operate as a subgroup. Further, because an additional rectifier for supplying DC power to the fourth inverter 234 is omitted, the number of rectifiers may be reduced and the cost of the product may be reduced.

The third and fourth coils 123 and 124 may still operate as two or one burner by separately receiving the drive current from the third and fourth inverters 233 and 234.

The switching circuit 131 may connect each of the first, second and third rectifiers 221, 222 and 223 to a corresponding one of the first external power supply PS1 or the second external power supply PS2. For example, the switching circuit 131 may connect the first and second rectifiers 221 and 222 to the first external power supply PS1 and may connect the third rectifier 223 to the second external power supply PS2. Accordingly, it is possible to supply power to the first and second coils 121 and 122, and the third and fourth coils 123 and 124 independently of each other.

The number of the plurality of coils 120, the plurality of inverters 230, and the plurality of rectifiers 220 is not limited thereto.

Figure 17:
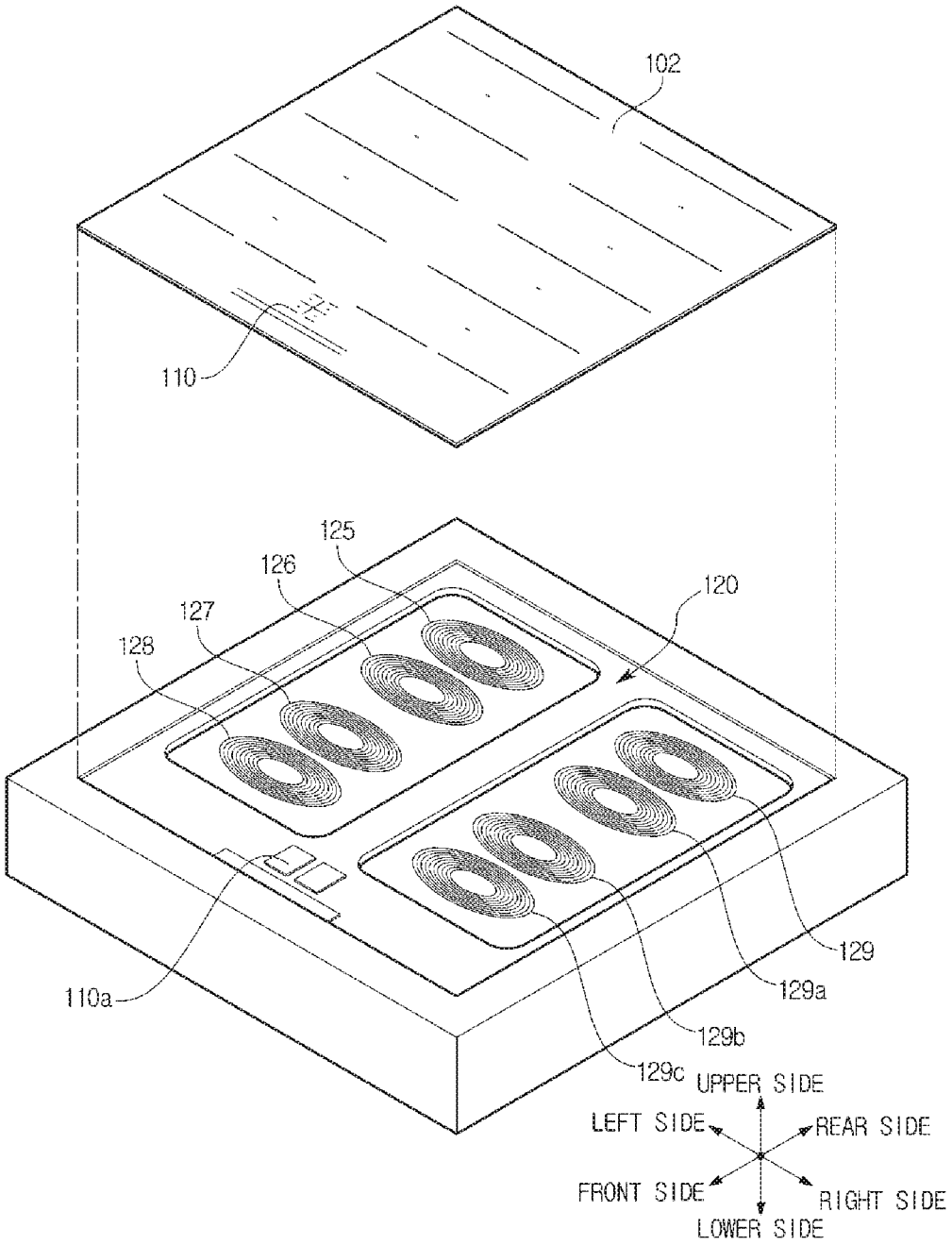
FIG. 17 illustrates a view of an interior of the cooking apparatus according to an embodiment of the disclosure.
Figure 18:
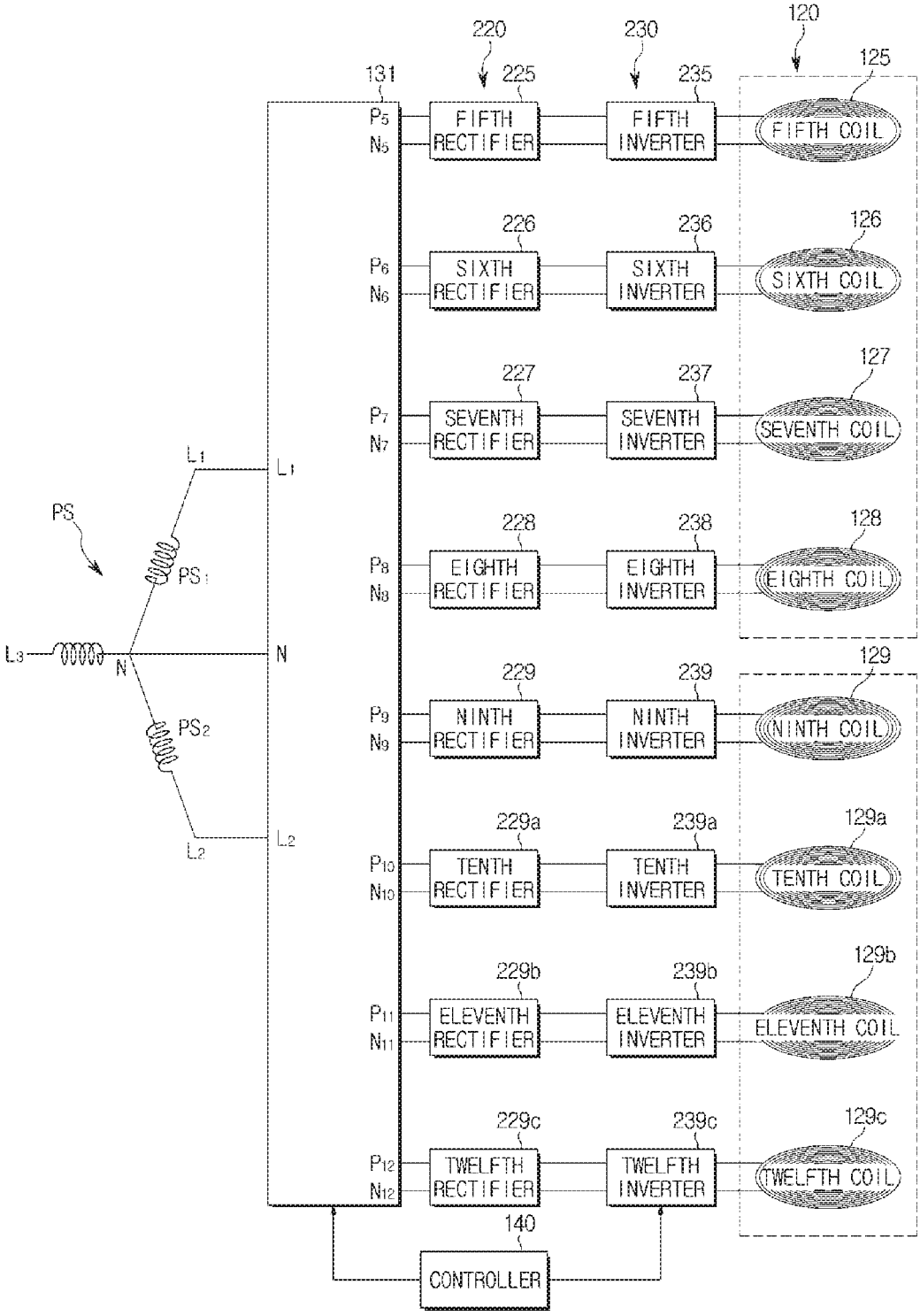
FIG. 18 illustrates a view of an example of a driver contained in the cooking apparatus according to an embodiment of the disclosure.
Figure 19:
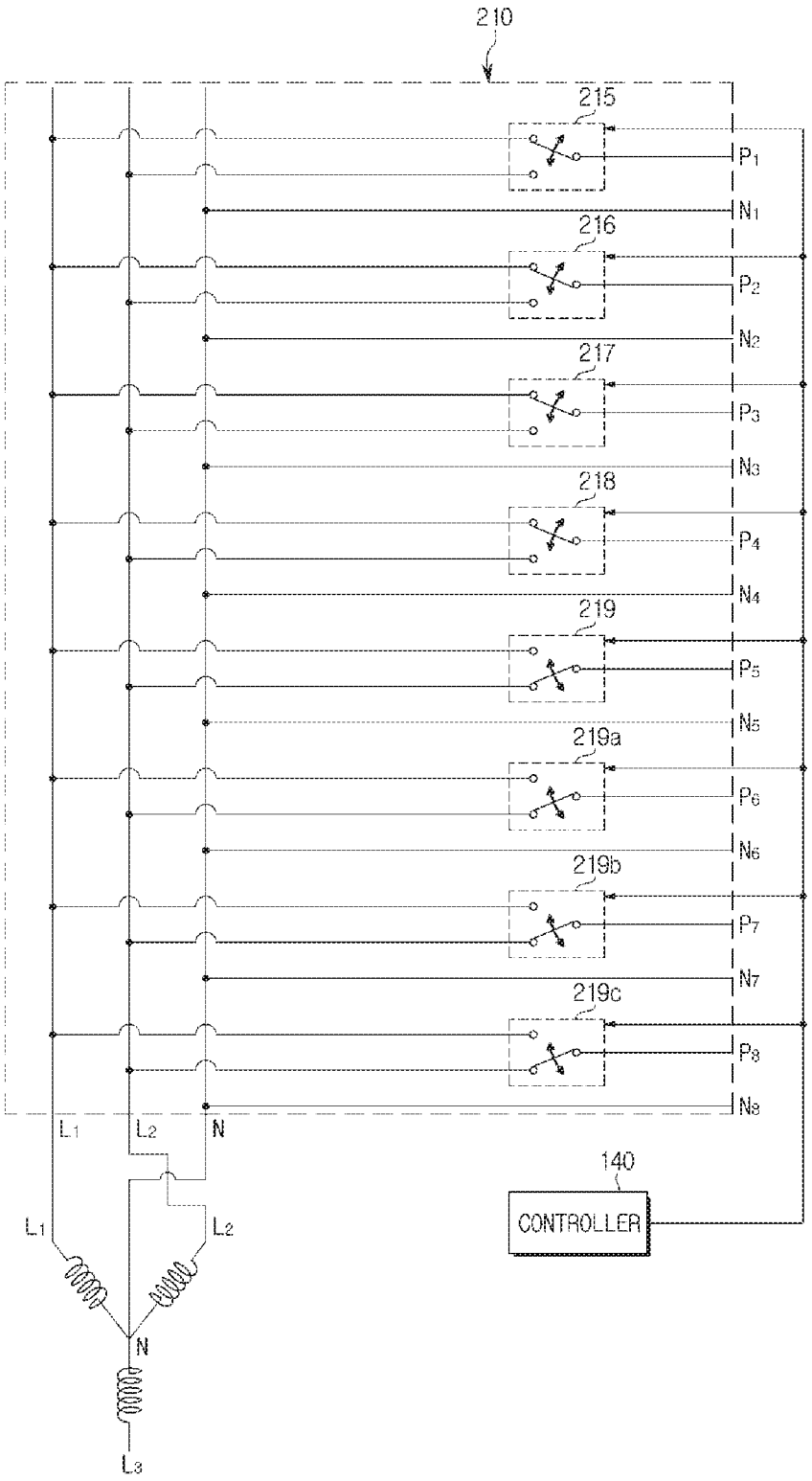
FIG. 19 illustrates a view of an example of a switching circuit contained in the cooking apparatus according to an embodiment of the disclosure.

FIG. 17 illustrates a view of an interior of the cooking apparatus according to an embodiment of the disclosure. FIG. 18 illustrates a view of an example of a driver contained in the cooking apparatus according to an embodiment of the disclosure. FIG. 19 illustrates a view of an example of a switching circuit contained in the cooking apparatus according to an embodiment of the disclosure.

Referring to FIGS. 17 to 19, the cooking apparatus 100 includes a plurality of coils 120, a driver 130 and a controller 140.

The plurality of coils 120 includes fifth, sixth, seventh, eighth, ninth, tenth, eleventh and twelfth coils 125, 126, 127, 128, 129, 129*a*, 129*b*, and 129*c*. The plurality of coils 120 each may be installed under the cooking plate 102 to generate a magnetic field and/or an electric field and/or an electromagnetic field for heating the cooking vessel 1.

As illustrated in FIG. 17, the plurality of coils 120 may be arranged in a predetermined pattern under the cooking plate 102. For example, the fifth, sixth, seventh and eighth coils 125, 126, 127 and 128 may be arranged in a first column (a left column of the cooking plate) and the ninth, tenth, eleventh and twelfth coils 129, 129*a*, 129*b*, and 129*c* may be arranged in a second column (a right column of the cooking plate).

The fifth to twelfth coils 125 to 129*c* may have magnitudes and numbers of turns different from those of the first to fourth coils 121 to 124 illustrated in FIG. 2. In other words, the fifth to twelfth coils 125 to 129*c* may have inductances different from those of the first to fourth coils 121 to 124 illustrated in FIG. 2.

The driver 130 may be supplied with power from the external power supply PS and may supply the drive current to the plurality of coils 120 according to the driving control signal of the controller 140. Particularly, according to the control signal of the controller 140, the driver circuit 133 may apply an AC voltage and output an AC (drive current) to the plurality of coils 120.

As illustrated in FIG. 18, the driver 130 includes a plurality of inverters 230, a plurality of rectifier 220 and the switching circuit 131.

The plurality of inverters 230 may be supplied with a DC voltage and a DC from the plurality of rectifiers 220, respectively and may apply an AC voltage and supply an AC to each of the plurality of coils 120, respectively.

The plurality of inverters 230 may include a fifth inverter 235 supplying a drive current to the fifth coil 125, a sixth inverter 236 supplying a drive current to the sixth coil 126, a seventh inverter 237 supplying a drive current to the seventh coil 127, an eighth inverter 238 supplying a drive current to the eighth coil 128, a ninth inverter 239 supplying a drive current to the ninth coil 129, a tenth inverter 239*a* supplying a drive current to the tenth coil 129*a*, an eleventh inverter 239*b* supplying a drive current to the eleventh coil 129*b*, and a twelfth inverter 239*c* supplying a drive current to the twelfth coil 129*c*.

At this time, the fifth to twelfth inverters 235 to 239*c* may supply a maximum AC, which is different from the first to fourth inverters 231 to 234 illustrated in FIG. 6, to the plurality of coils 120.

The plurality of rectifiers 220: 225, 226, 227, 228, 229, 229*a*, 229*b*, and 229*c* may apply the DC voltage and supply the DC to the plurality of inverters 235, 236, 237, 238, 239, 239*a*, 239*b*, and 239*c*, respectively.

The plurality of rectifiers 220 may include a fifth rectifier 225 supplying DC power to the fifth inverter 235, a sixth rectifier 226 supplying DC power to the sixth inverter 236, a seventh rectifier 227 supplying DC power to the seventh inverter 237, an eighth rectifier 228 supplying DC power to the eighth inverter 238, a ninth rectifier 229 supplying DC power the ninth inverter 239, a tenth rectifier 229*a* supplying DC power to the tenth inverter 239*a*, an eleventh rectifier 229*b* supplying DC power to the eleventh inverter 239*b*, and a twelfth rectifier 229*c* supplying DC power to the twelfth inverter 239*c*.

At this time, the fifth to twelfth rectifiers 225 to 229*c* may supply a maximum DC, which is different from the first to fourth rectifiers 221 to 224 illustrated in FIG. 6, to the plurality of inverters 230.

The external power supply PS may include a first external power supply PS1 and a second external power supply PS2 for supplying AC power having different phases to the cooking apparatus 100.

As illustrated in FIG. 19, the switching circuit 131 may selectively connect the plurality of rectifiers 220 to the external power supply PS. Particularly, the switching circuit 131 may selectively connect the fifth to twelfth rectifiers 225 to 229*c* to the first external power supply PS1 or the second external power supply PS2. For example, under the control of the controller 140, the switching circuit 131 may connect the fifth, sixth, seventh and eighth rectifiers 225, 226, 227 and 228 to the first external power supply PS1, and may connect the ninth, tenth, eleventh, and twelfth rectifiers 229, 229*a*, 229*b*, and 229*c* to the second external power supply PS2.

The switching circuit 131 may be connected to the first and second external power supplies PS1 and PS2 and may be connected to the fifth to twelfth rectifiers 225 to 229*c*. The switching circuit 131 may include first and second phase terminals L1 and L2 and a neutral terminal N connected to the first and second external power supplies PS1 and PS2, respectively. Further, the switching circuit 131 may include fifth, sixth, seventh, eighth, ninth, tenth, and eleventh positive/negative terminals P5/N5, P6/N6, P7/N7, P8/N8, P9/N9, P10/N10, P11/N11, and P12/N12 connected to the fifth, sixth, seventh, eighth, ninth, tenth, eleventh and twelfth rectifiers 225, 226, 227, 228, 229, 229*a*, 229*b* and 229*c*, respectively.

The fifth to twelfth negative terminals N5 to N12 may be connected to the neutral terminal N of the external power supply PS.

The switching circuit 131 may include a plurality of switch modules 210: 215, 216, 217, 217, 219, 219*a*, 219*b*, and 219*c* connecting selectively the fifth to twelfth terminals P5 to P12 to the first phase terminal L1 or the second phase terminals L2.

The plurality of switch modules 210 may include a fifth switch module 215 connected to the fifth positive terminal P5, a sixth switch module 216 connected to the sixth positive terminal P6, a seventh switch module 217 connected to the seventh positive terminal P7, an eighth switch module 218 connected to the eighth positive terminal P8, a ninth switch module 219 connected to the ninth positive terminal P9, a tenth switch module 219*a* connected to the tenth positive terminal P10, an eleventh switch module 219*b* connected to the eleventh positive terminal P11 and a twelfth switch module 219*c* connected to the twelfth positive terminal P12.

According to the control signal of the controller 140, the fifth to twelfth switch modules 215 to 219*c* may connect each of the fifth to twelfth positive terminals P5 to P12 to a corresponding one of the first phase terminal L1 or the second phase terminal L2.

For example, the controller 140 may control the fifth, sixth, seventh, and eighth switch modules 215, 216, 217 and 218 so that the fifth, sixth, seventh, and eighth positive terminals P5, P6, P7, and P8 are connected to the first phase terminal L1. The controller 140 may control the ninth, tenth, eleventh and twelfth switch modules 219, 219*a*, 219*b*, and 219*c* so that the ninth, tenth, eleventh and twelfth positive terminals P9, P10, P11 and P12 is connected to the second phase terminal L2.

Accordingly, power may be evenly supplied to the fifth to twelfth coils 125 to 129*c* from the first and second external power supplies PS1 and PS2.

Further, the fifth, sixth, seventh and eighth coils 125, 126, 127, and 128 arranged in the left column may operate as four, three, two, or one burner, depending on a user input. The ninth, tenth, eleventh and twelfth coils 129, 129*a*, 129*b* and 129*c* arranged in the right column may also operate as two or one burner depending on a user input.

According to the output of the coils 125 to 129*c*, the controller 140 may change the connection between the fifth to twelfth terminals P5 to P12 and the first and second phase terminals L1 and L2. For example, when the fifth coil 125 and the sixth coil 126 operate simultaneously and when the sum of the output of the fifth coil 125 and the output of the sixth coil 126 is greater than the reference output, the controller 140 may control the fifth switch module 215 so that the fifth positive terminal P5 is connected to the first phase terminal L1, and may control the sixth switch module 216 so that the sixth positive terminal P6 is connected to the second phase terminal L2. The controller 140 may control other switch module in the same manner.

Accordingly, a maximum output of a coil on which a load is concentrated, among the plurality of coils 120 may be increased. For example, when the load is concentrated on the fifth and sixth coils 125 and 126, the controller 140 may supply power to the fifth and sixth coils 125 and 126 from the first and second power supplies PS1 and PS2, respectively.

As mentioned above, the cooking apparatus 100 may control eight coils 125 to 129*c* independently of each other by using eight inverters 235 to 239*c* supplying the drive current to the eight coils 125 to 129*c*, respectively. Because the eight inverters 235 to 239*c* correspond to eight rectifiers 225 to 229*c* on a one-to-one basis, the cooking apparatus 100 may supply power to the eight coils 125 to 129*c* independently of each other. Further, by using the switching circuit 131 connecting each of the eight rectifiers 225 to 229*c* to a corresponding one of the first power supply PS1 or the second power supply PS2, the cooking apparatus 100 may increase the maximum power supplied to the eight coils 125 to 129*c*.

Figure 20:
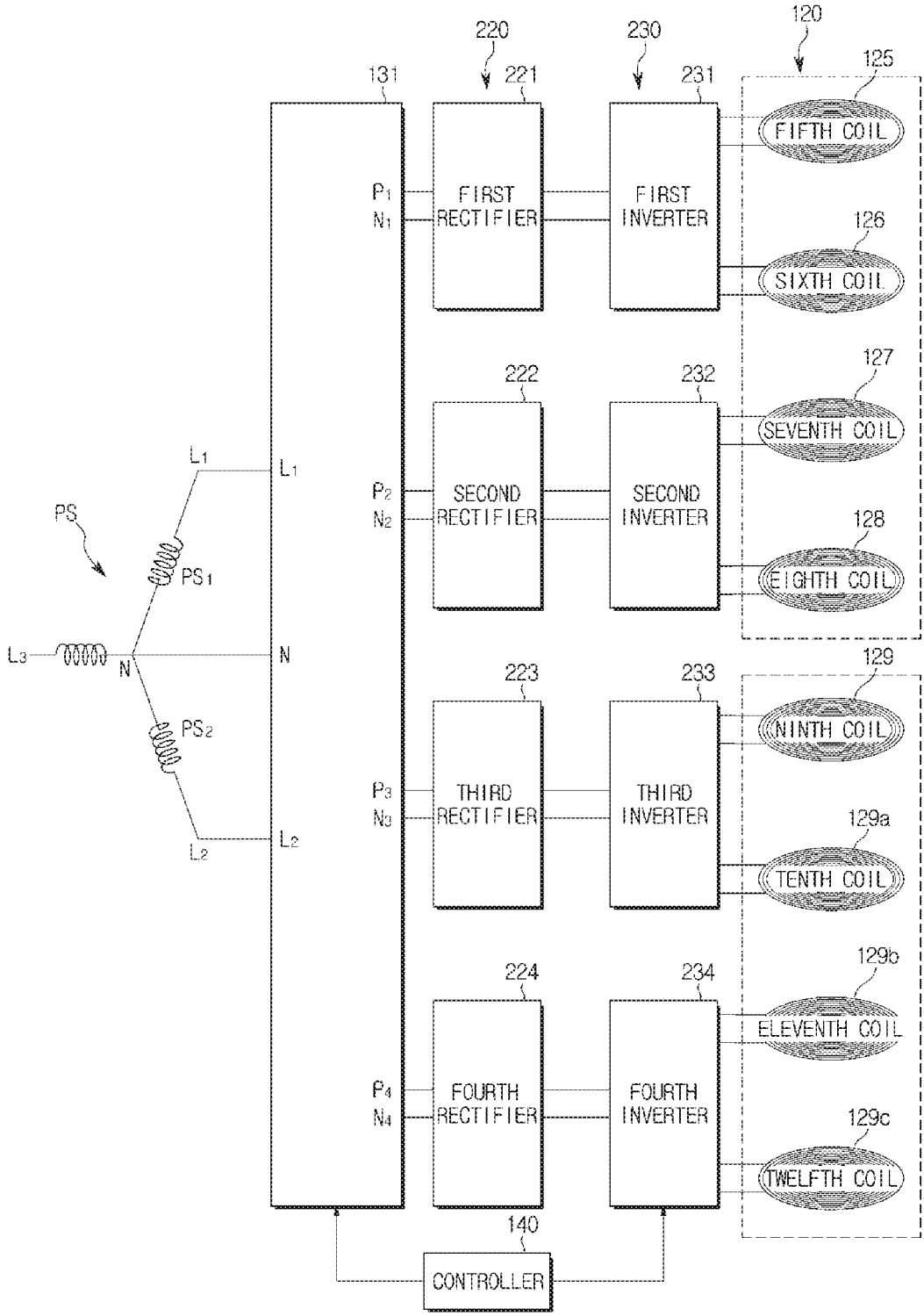
FIG. 20 illustrates a view of another example of the driver contained in the cooking apparatus according to an embodiment of the disclosure.

FIG. 20 illustrates a view of another example of the driver contained in the cooking apparatus according to an embodiment of the disclosure.

Referring to FIG. 20, the cooking apparatus 100 includes a plurality of coils 120, a driver 130, and a controller 140.

The plurality of coils 120: 125, 126, 127, 128, 129, 129*a*, 129*b*, and 129*c* includes fifth, sixth, seventh and eighth coils 125, 126, 127 and 128 arranged in a first column (a left column of the cooking plate) and ninth, tenth, eleventh and twelfth coils 129, 129*a*, 129*b* and 129*c* arranged in a second column (a right column of the cooking plate). The fifth to twelfth coils 125 to 129*c* may have inductances different from those of the first to fourth coils 121 to 124 illustrated in FIG. 2.

The driver 130 includes a plurality of inverters 230, a plurality of rectifiers 220, and a switching circuit 131.

The plurality of inverters 230 may include a first inverter 231 supplying a drive current to the fifth and sixth coils 125 and 126, a second inverter 231 supplying a drive current to the seventh and eighth coils 127 and 128, a third inverter 233 supplying a drive current to the ninth and tenth coils 129 and 129*a* and a fourth inverter 234 supplying a drive current to the eleventh and twelfth coils 129*a* and 129*b*.

According to a control signal of the controller 140, each of the plurality of inverters 231, 232, 233 and 234 may supply a drive current to corresponding designated two coils 125 and 126, 127 and 127 and 128, 129 and 129*a*, and 129*b* and 129*c* or a corresponding one of designated two coils 125 and 126, 127 and 127 and 128, 129 and 129*a*, and 129*b* and 129*c*. For example, the first inverter 231 may supply the drive current to both of the fifth and sixth coils 125 and 126, or may supply the drive current to one of the fifth and sixth coils 125 and 126. The second inverter 232 may supply the drive current to both of the seventh and eighth coils 127 and 128 or may supply the drive current to one of the seventh and eighth coils 127 and 128. The third inverter 233 may supply the drive current to both of the ninth and tenth coils 129 and 129*a* or may supply the drive current to one of the ninth and tenth coils 129 and 129*a*. Under the control of the controller 140, the fourth inverter 234 may supply the drive current to both of the eleventh and twelfth coils 129*b* and 129*c* or may supply the drive current to one of the eleventh and twelfth coils 129*b* and 129*c*.

The plurality of rectifiers 220 may include a first rectifier 221 supplying DC power to the first inverter 231, a second rectifier 222 supplying DC power to the second inverter 232, a third rectifier 223 supplying DC power to the third inverter 233 and a fourth rectifier 224 supplying DC power to the fourth inverter 234.

The switching circuit 131 may selectively connect the first, second, third and fourth rectifiers 221, 222, 223 and 224 to the first power supply PS1 or the second power supply PS2. For example, under the control of the controller 140, the switching circuit 131 may connect the first and second rectifiers 221 and 222 to the first power supply PS1, and may connect the third and fourth rectifiers 223 and 224 to the second power supply PS2.

As mentioned above, because the four inverters 231 to 235 correspond to the four rectifiers 221 to 224 on a one-to-one basis, the cooking apparatus 100 may supply power to the eight coils 125 to 129*c* independently of each other. Further, by using the switching circuit 131 connecting each of the four rectifiers 221 to 224 to a corresponding one of the first power supply PS1 or the second power supply PS2, the cooking apparatus 100 may increase the maximum power supplied to the eight coils 125 to 129*c*.

Figure 21:
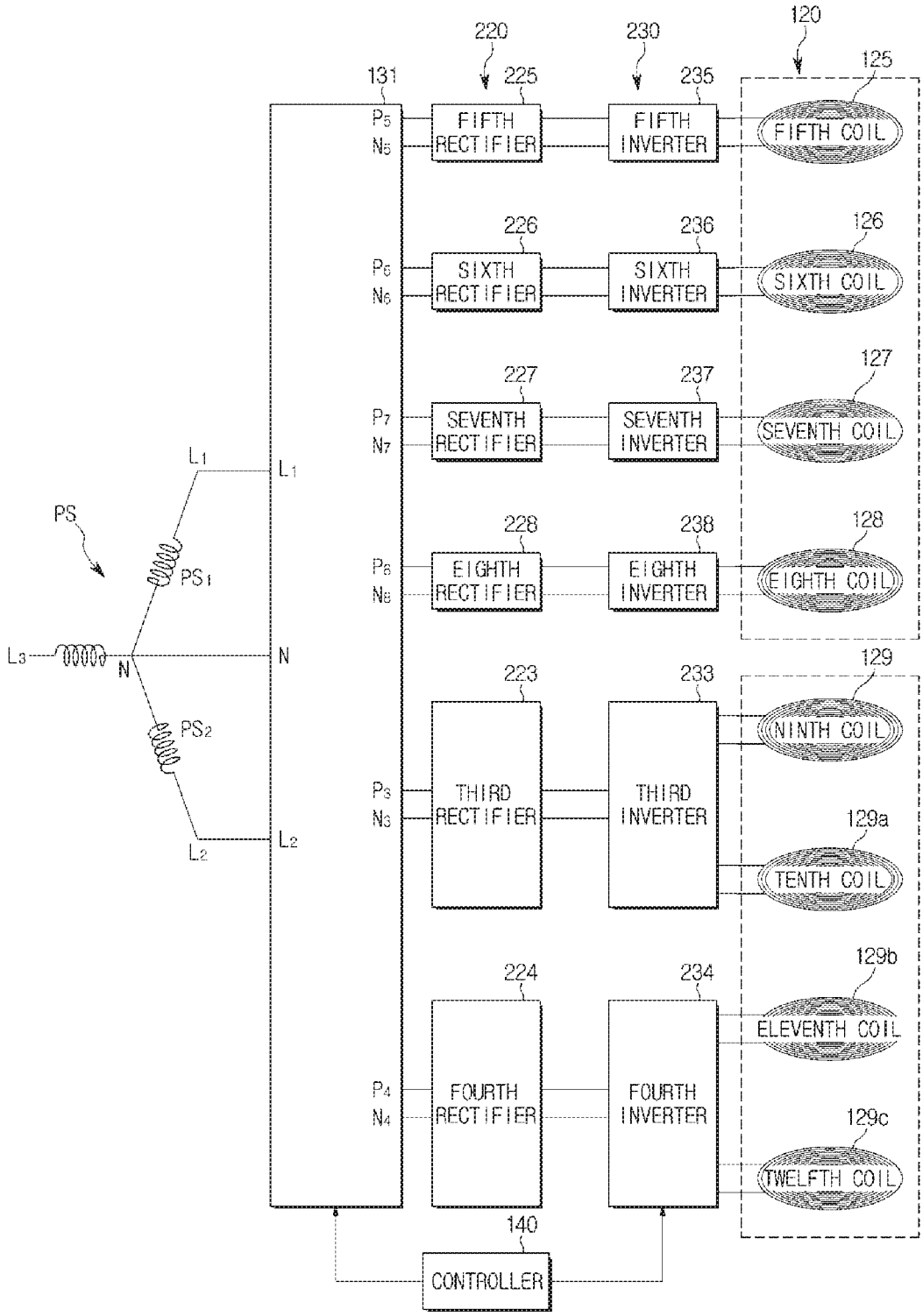
FIG. 21 illustrates a view of another example of the driver contained in the cooking apparatus according to an embodiment of the disclosure.

FIG. 21 illustrates a view of another example of the driver contained in the cooking apparatus according to an embodiment of the disclosure.

Referring to FIG. 21, a cooking apparatus 100 includes a plurality of coils 120, a driver 130, and a controller 140.

The plurality of coils 120 may include fifth, sixth, seventh, eighth, ninth, tenth, eleventh and twelfth coils 125, 126, 127, 128, 129, 129*a*, 129*b*, and 129*c*, and a configuration and an operation of the plurality of coils 120 may be the same as the plurality of coils illustrated in FIG. 2.

The driver 130 includes a plurality of inverters 230, a plurality of rectifiers 220, and a switching circuit 131.

The plurality of inverters 230 may include fifth, sixth, seventh, and eighth inverters 235, 236, 237 and 238 respectively supplying a drive current to the fifth, sixth, seventh, and eighth coils 125, 126, 127, and 128 in the left column, a third inverter 233 supplying a drive current to the ninth and tenth coils 129 and 129*a*, and a fourth inverter 234 supplying a drive current to the eleventh and twelfth coils 129*b* and 129*c*.

An operation of the fifth, sixth, seventh and eighth inverters 235, 236, 237 and 238 may be the same as the operation of the fifth, sixth, seventh and eighth inverters illustrated in FIG. 18.

An operation of the third and fourth inverters 233 and 234 may be the same as the operation of the third and fourth inverters illustrated in FIG. 20.

The plurality of rectifiers 220 may include fifth, sixth, seventh, eighth, third and fourth rectifiers 225, 226, 227, 228, 223, and 224 respectively supplying DC power to the fifth, sixth, seventh, eighth, third and fourth inverters 235, 236, 237, 238, 233, and 234.

The switching circuit 131 may selectively connect the fifth, sixth, seventh, eighth, third and fourth rectifiers 225, 226, 227, 228, 223, and 224 to the first power supply PS1 or the second power supply PS2. For example, under the control of the controller 140, the switching circuit 131 may connect the fifth, sixth, seventh and eighth rectifiers 225, 226, 227 and 228 to the first power supply PS1 and may connect the third and fourth rectifiers 223, and 224 to the second power supply PS2.

As mentioned above, because the six inverters 235, 236, 237, 238, 233, and 234 correspond to the six rectifiers 225, 226, 227, 228, 223, and 224 on a one-to-one basis, the cooking apparatus 100 may supply power to the eight coils 125 to 129*c* independently of each other. Further, by using the switching circuit 131 connecting each of the six rectifiers 225, 226, 227, 228, 223, and 224 to a corresponding one of the first power supply PS1 or the second power supply PS2, the cooking apparatus 100 may increase the maximum power supplied to the eight coils 125 to 129*c*.

Figure 22:
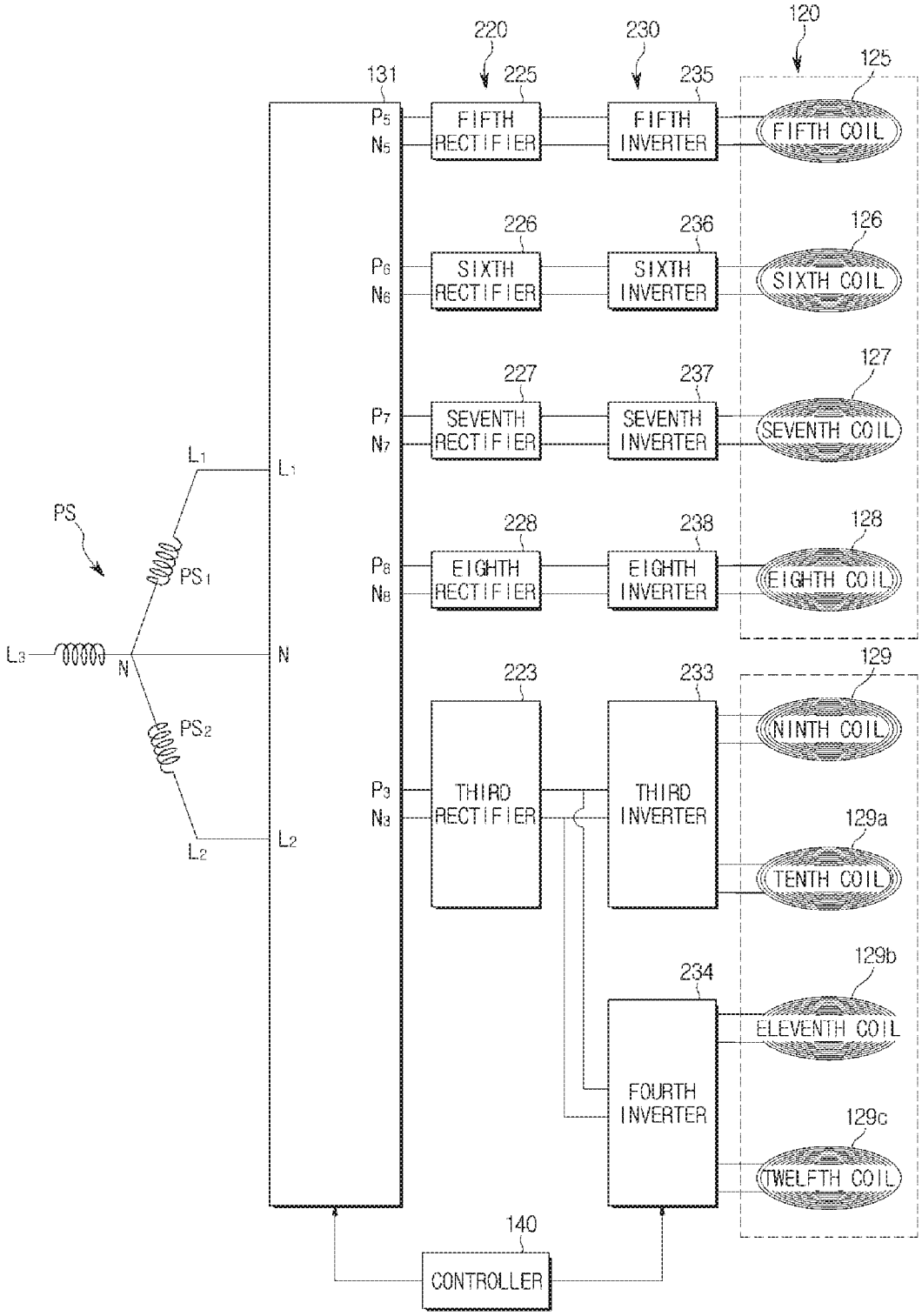
FIG. 22 illustrates a view of another example of the driver contained in the cooking apparatus according to an embodiment of the disclosure.

FIG. 22 illustrates a view of another example of the driver contained in the cooking apparatus according to an embodiment of the disclosure.

Referring to FIG. 22, the cooking apparatus 100 includes a plurality of coils 120, a driver 130, and a controller 140.

The plurality of coils 120 may include fifth, sixth, seventh, eighth, ninth, tenth, eleventh and twelfth coils 125, 126, 127, 128, 129, 129*a*, 129*b*, and 129*c*, and a configuration and an operation of the plurality of coils 120 may be the same as the plurality of coils illustrated in FIG. 20.

The driver 130 includes a plurality of inverters 230, a plurality of rectifiers 220, and a switching circuit 131.

The plurality of inverters 230 may include fifth, sixth, seventh, eighth, third and fourth inverters 235, 236, 237, 238, 233, and 234 and a configuration and an operation of the plurality of inverters 230 may be the same as the plurality of inverters of FIG. 21.

The plurality of rectifiers 220 may include fifth, sixth, seventh, and eighth, rectifiers 225, 226, 227, and 228 respectively supplying DC power to the fifth, sixth, seventh, and eighth inverters 235, 236, 237, and 238, and a third rectifier 223 supplying DC power to the third and fourth inverters 233 and 234. Accordingly, the third rectifier 223 may supply the DC power to the third and fourth inverters 233 and 234, thereby reducing the number of rectifiers and reducing the cost of the product.

Because the third and fourth inverters 233 and 234 are supplied with DC power from the third rectifier 223, the ninth, tenth, eleventh, and twelfth coils 129, 129*a*, 129*b*, and 129*c* may operate as a subgroup. By respectively receiving the drive current from the third and fourth inverters 233 and 234, the ninth, tenth, eleventh, and twelfth coils 129, 129*a*, 129*b*, and 129*c* may operate as four, three, two or a single burner.

The switching circuit 131 may connect each of the fifth, sixth, seventh, eighth and third rectifiers 225, 226, 227, 228 and 223 to a corresponding one of the first external power supply PS1 or the second external power supply PS2. For example, the switching circuit 131 may connect the fifth, sixth, seventh and eighth rectifiers 225, 226, 227 and 228 to the first external power supply PS1 and may connect the third rectifier 223 to the second external power supply PS2.

As mentioned above, because the single rectifier 223 supplies the DC power to the two inverters 233 and 234, it is possible to omit a single rectifier that is to supply the DC power to the inverter, thereby reducing the number of rectifiers and reducing the cost of the product.

Figure 23:
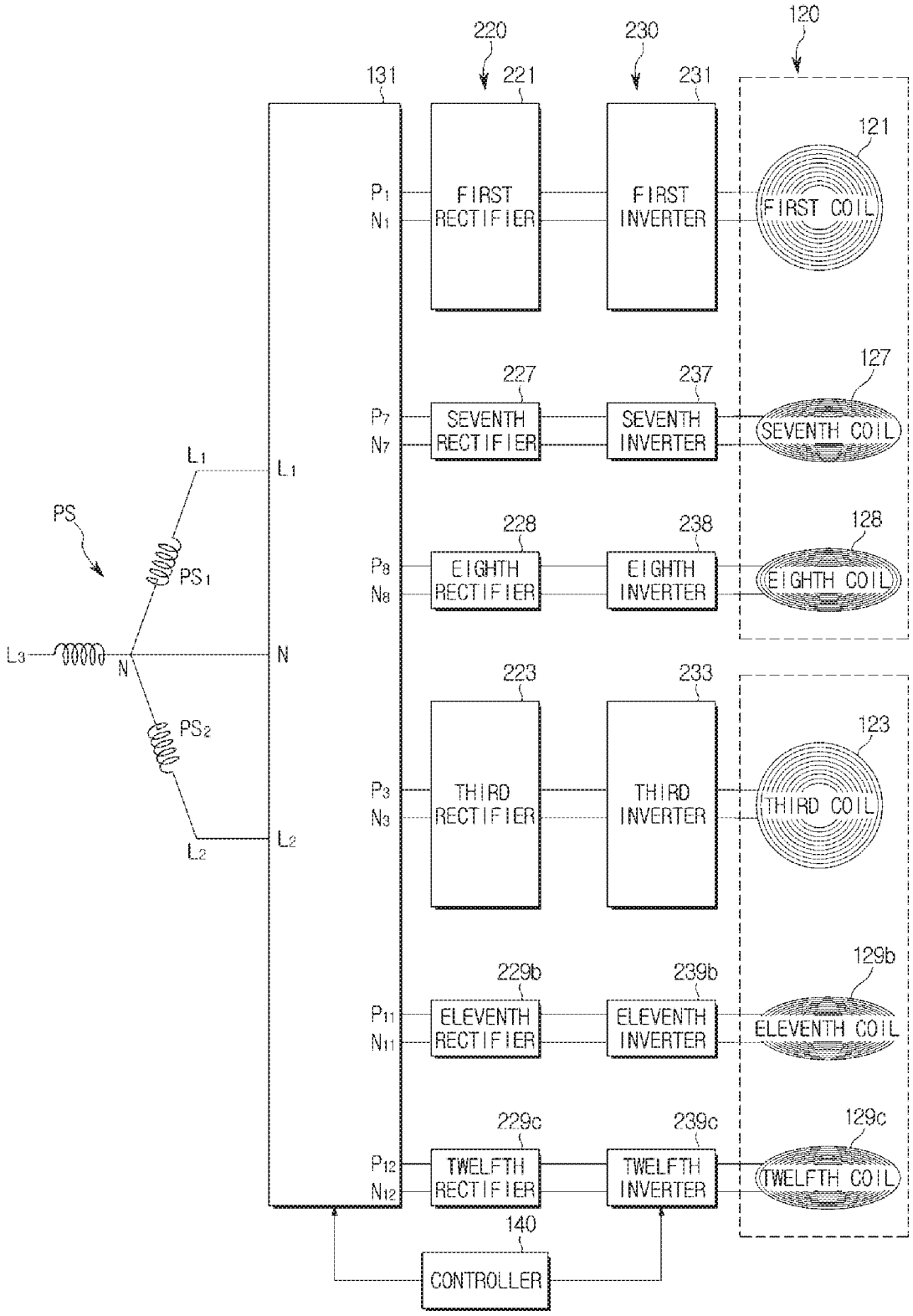
FIG. 23 illustrates a view of another example of the driver contained in the cooking apparatus according to an embodiment of the disclosure.

FIG. 23 illustrates a view of another example of the driver contained in the cooking apparatus according to an embodiment of the disclosure.

Referring to FIG. 23, the cooking apparatus 100 includes a plurality of coils 120, a driver 130, and a controller 140.

The plurality of coils 120 may include first, seventh, eighth, third, eleventh and twelfth coils 121, 127, 128, 123, 129*b*, and 129*c*.

The plurality of coils 120 may be arranged in a predetermined pattern under the cooking plate 102. For example, the first, seventh and eighth coils 121, 127 and 128 may be arranged in a first column (a left column of the cooking plate) and the third, eleventh and twelfth coils 123, 129*b*, and 129*c* may be arranged in a second column (a right column of the cooking plate).

The first and third coils 121 and 123 may have inductances different from those of the seventh, eighth, eleventh and twelfth coils 127, 128, 129*b* and 129*c*.

The driver 130 includes a plurality of inverters 230, a plurality of rectifiers 220, and a switching circuit 131.

The plurality of inverters 230 may include a first inverter 231 supplying a drive current to the first coil 121, a seventh inverter 237 supplying a drive current to the seventh coil 127, an eighth inverter 238 supplying a drive current to the eighth coil 128, a third inverter 233 supplying a drive current to the third coil 123, and an eleventh inverter 239*b* supplying a drive current to the eleventh coil 129*b* and a twelfth inverter 239*c* supplying a drive current to the twelfth coil 129*c*.

The first and third inverters 231 and 233 and the seventh, eighth, eleventh and twelfth inverters 237, 238, 239*b* and 239*c* may supply a different maximum AC to the plurality of coils 120.

The plurality of rectifiers 220 may include a first rectifier 221 supplying DC power to the first inverter 231, a seventh rectifier 227 supplying DC power to the seventh inverter 237, an eighth rectifier 228 supplying DC power to the eight inverter 238, a third rectifier 223 supplying DC power DC power to the third inverter 233, an eleventh rectifier 229*b* supplying DC power to the eleventh inverter 239*b*, and a twelfth rectifier 229*c* supplying DC power to the twelfth inverter 239*c*.

The first and third inverters 231 and 233 and the seventh, eighth, eleventh and twelfth inverters 237, 238, 239*b* and 239*c* may supply a different maximum DC to the plurality of inverters 230.

The switching circuit 131 may selectively connect the first, third, seventh, eighth, eleventh and twelfth rectifiers 221, 223, 227, 228, 229*b* and 229*c* to the first power supply PS1 or the second power supply PS2. For example, under control of the controller 140, the switching circuit 131 may connect the first, seventh, and eighth rectifiers 221, 227, and 228 to the first power supply PS1, and may connect the third, eleventh, and twelfth rectifiers 223, 229*b*, and 229*c* to the second power supply PS2.

As mentioned above, by using the six inverters 231, 237, 238, 233, 239*b*, and 239*c*, the cooking apparatus 100 may control the six coils 121, 127, 128, 123, 129*b*, and 129*c* independently of each other. Because the six inverters 231, 237, 238, 233, 239*b*, and 239*c* correspond to the six rectifiers 221, 227, 228, 223, 229*b*, and 229*c* on a one-to-one basis, the cooking apparatus 100 may supply power to the six coils 121, 127, 128, 123, 129*b*, and 129*c* independently of each other. Further, by using the switching circuit 131 connecting each of the six rectifiers 221, 227, 228, 223, 229*b*, and 229*c* to a corresponding one of the first power supply PS1 or the second power supply PS2, the cooking apparatus 100 may increase the maximum power supplied to the six coils 121, 127, 128, 123, 129*b*, and 129*c*.

Figure 24:
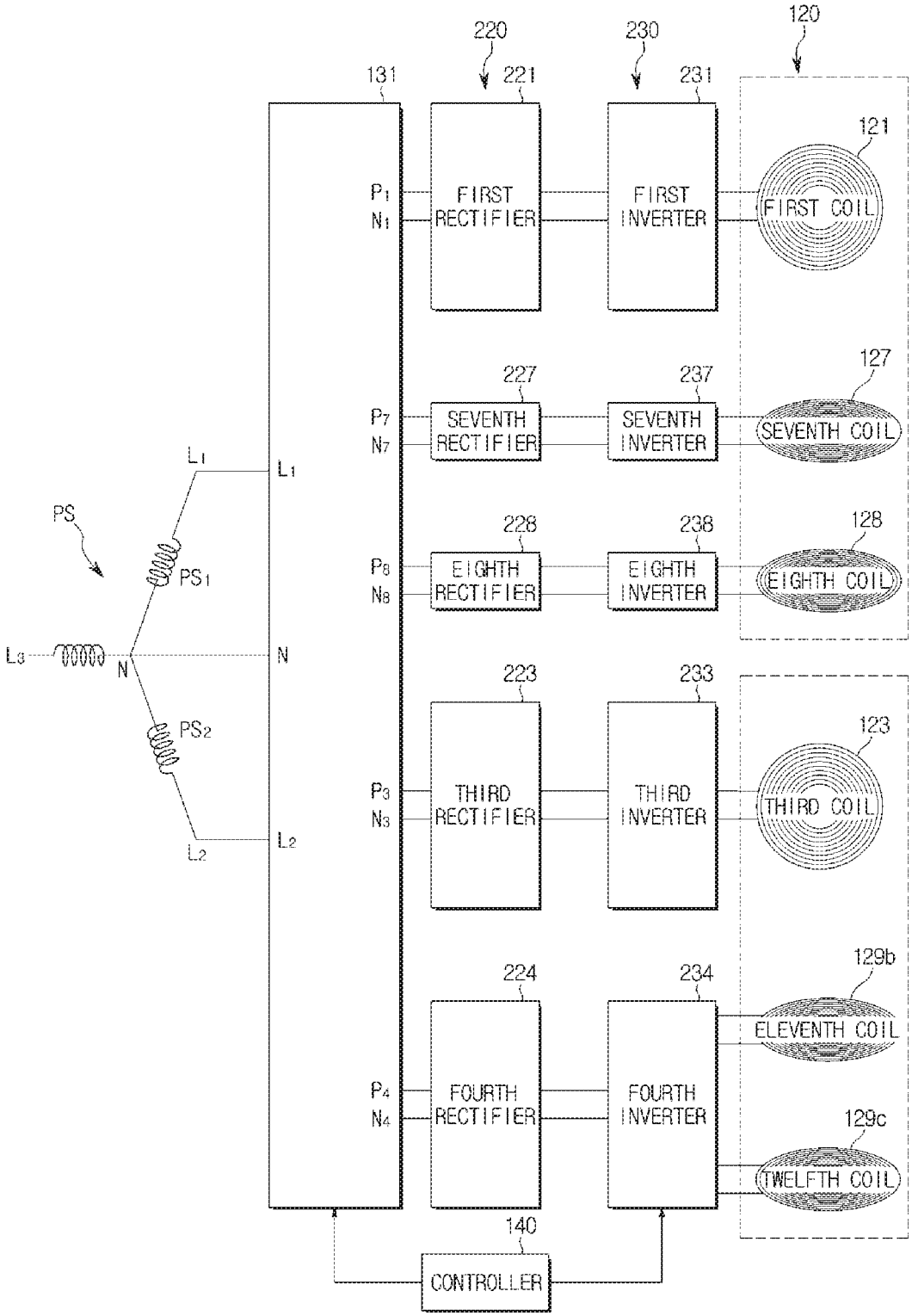
FIG. 24 illustrates a view of another example of the driver contained in the cooking apparatus according to an embodiment of the disclosure.

FIG. 24 illustrates a view of another example of the driver contained in the cooking apparatus according to an embodiment of the disclosure.

Referring to FIG. 24, the cooking apparatus 100 includes a plurality of coils 120, a driver 130, and a controller 140.

The plurality of coils 120 may include first, third, seventh, eighth, eleventh and twelfth coils 121, 123, 127, 128, 129*b*, and 129*c*, and a configuration and an operation of the plurality of coils 120 may be the same as the plurality of coils illustrated in FIG. 23.

The driver 130 includes a plurality of inverters 230, a plurality of rectifiers 220, and a switching circuit 131.

The plurality of inverters 230 may include a first inverter 231 supplying a drive current to the first coil 121, a seventh inverter 237 supplying a drive current to the seventh coil 127, an eighth inverter 238 supplying a drive current to the eighth coil 128, a third inverter 233 supplying a drive current to the third coil 123, and a fourth inverter 234 supplying a drive current to the eleventh and twelfth coils 129*b* and 129*c*.

The first, third, seventh and eighth inverters 231, 233, 237 and 238 may supply the drive current to the first, third, seventh and eighth coils 121, 123, 127 and 128, respectively. Under the control of the controller 140, the fourth inverter 234 may supply the drive current to the eleventh and twelfth coils 129*b* and 129*c* or may supply the drive current to one of the eleventh and twelfth coils 129*b* and 129*c*.

The plurality of rectifiers 220 may include a first rectifier 221 supplying DC power to the first inverter 231, a seventh rectifier 227 supplying DC power to the seventh inverter 237, an eighth rectifier 228 supplying DC power to the eighth inverter 238, a third rectifier 223 supplying DC power to the third inverter 233, and a fourth rectifier 224 supplying DC power to the fourth inverter 234.

The switching circuit 131 may selectively connect the first, seventh, eighth, third and fourth rectifiers 221, 227, 228, 223 and 224 to the first power supply PS1 or the second power supply PS2. For example, under control of the controller 140, the switching circuit 131 may connect the first, seventh, and eighth rectifiers 221, 227, and 228 to the first power supply PS1 and may connect the third and fourth rectifiers 223 and 234 to the second power supply PS2.

As mentioned above, because the five inverters 231, 237, 238, 233, and 234 correspond to the five rectifiers 221, 227, 228, 223, and 224 on a one-to-one basis, the cooking apparatus 100 may supply power to the six coils 121, 127, 128, 123, 129*b*, and 129*c* independently of each other. Further, by using the switching circuit 131 connecting each of the five rectifiers 221, 227, 228, 223, and 224 to a corresponding one of the first power supply PS1 or the second power supply PS2, the cooking apparatus 100 may increase the maximum power supplied to the six coils 121, 127, 128, 123, 129*b*, and 129*c*.

Figure 25:
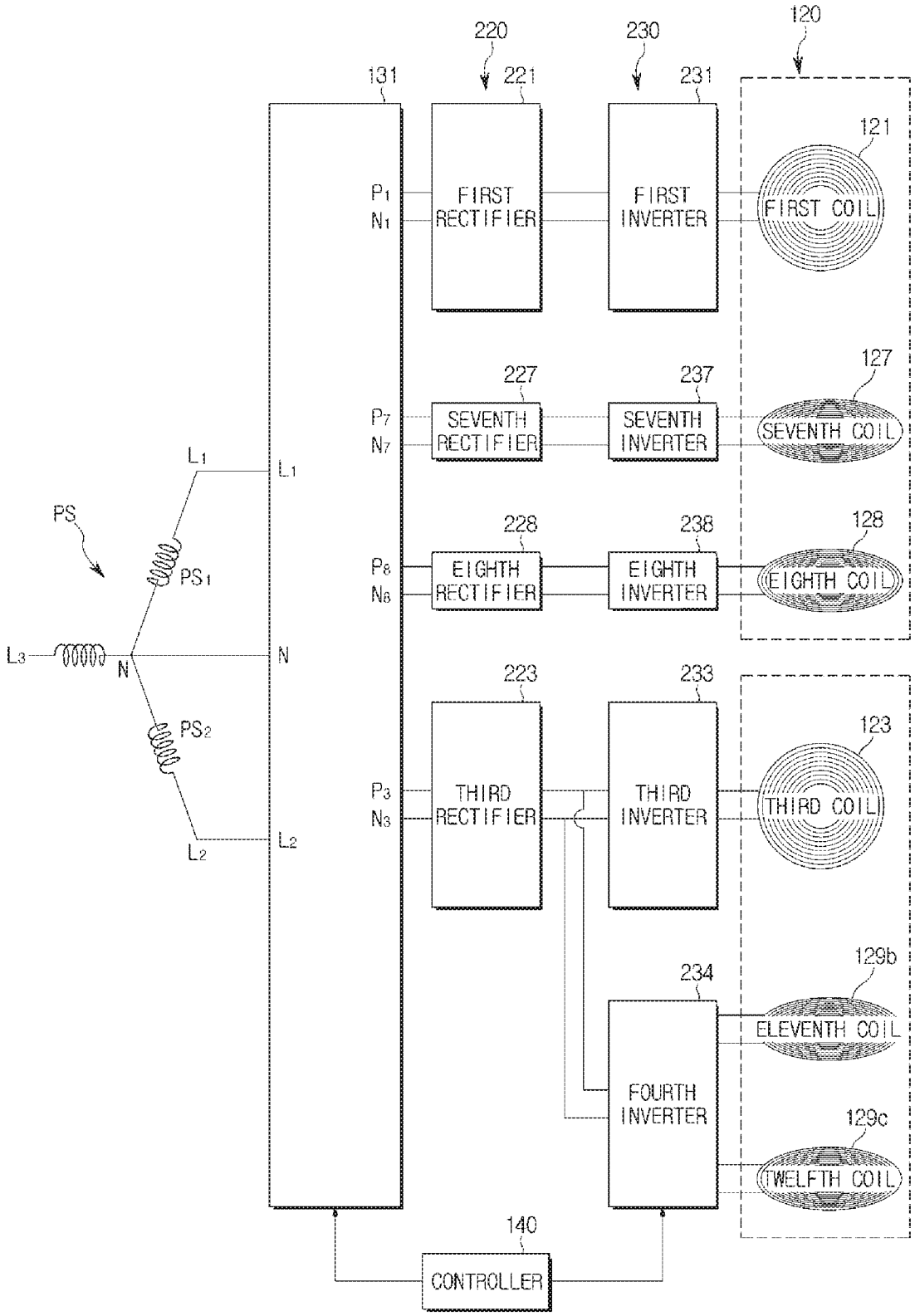
FIG. 25 illustrates a view of another example of the driver contained in the cooking apparatus according to an embodiment of the disclosure.

FIG. 25 illustrates a view of another example of the driver contained in the cooking apparatus according to an embodiment of the disclosure.

Referring to FIG. 25, the cooking apparatus 100 includes a plurality of coils 120, a driver 130, and a controller 140.

The plurality of coils 120 may include first, third, seventh, eighth, eleventh and twelfth coils 121, 123, 127, 128, 129*b*, and 129*c*, and a configuration and an operation of the plurality of coils 120 may be the same as the plurality of coils of FIG. 23.

The driver 130 includes a plurality of inverters 230, a plurality of rectifiers 220, and a switching circuit 131.

The plurality of inverters 230 may include first, seventh, eighth, third and fourth inverters 231, 237, 237, 233, and 234, and a configuration and an operation of the plurality of inverters 230 may be the same as the plurality of inverters of FIG. 21.

The plurality of rectifiers 220 may include first, seventh and eighth rectifiers 221, 227 and 228 respectively supplying DC power to the first, seventh and eighth inverters 231, 237, and 238, and a third rectifier 223 supplying DC power to the third and fourth inverters 233 and 234. Accordingly, the third rectifier 223 may supply DC power to the third and fourth inverters 233 and 234, thereby reducing the number of the rectifiers and the cost of the product.

Because the third and fourth inverters 233 and 234 are supplied with the DC power from the third rectifier 223, the third, eleventh and twelfth coils 123, 129*b*, and 129*c* may operate as a subgroup. Further, by respectively receiving the driver current from the third and fourth inverters 233 and 234, the third, eleventh and twelfth coils 123, 129*b*, and 129*c* may operate as three, two or one burner.

The switching circuit 131 may connect each of the first, seventh, eighth, and third rectifiers 221, 227, 228, and 223 to a corresponding one of the first power supply PS1 or the second power supply PS2. For example, the switching circuit 131 may connect the first, seventh, and eighth rectifiers 221, 227, and 228 to the first power supply PS1 and may connect the third rectifier 223 to the second power supply PS2.

As mentioned above, because the single rectifier 223 supplies the DC power to the two inverters 233 and 234, a single rectifier for supplying the DC power to the inverter is omitted, thereby reducing the number of rectifiers and the cost of the product.

Figure 26:
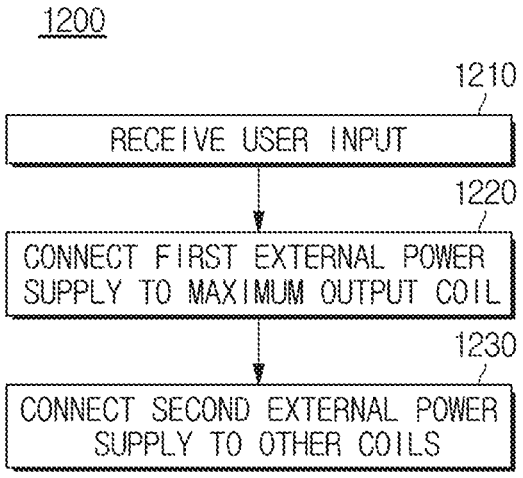
FIG. 26 illustrates a view of another example of operation of the power distribution of the cooking apparatus according to an embodiment of the disclosure.

FIG. 26 illustrates a view of another example of operation of the power distribution of the cooking apparatus according to an embodiment of the disclosure.

Power distribution (1200) of the cooking apparatus 100 will be described with reference to FIG. 26.

The cooking apparatus 100 receives a user input from a user (1210).

The cooking apparatus 100 may receive information (or a command) on an output level from the user.

The operation 1210 may be identical to the operation 1010 described in conjunction with FIG. 12.

The cooking apparatus 100 connects the maximum output coil to the first external power supply PS1 (1220).

The controller 140 may identify required power of the plurality of coils 120 based on the user input that is inputted through the user interface 110. The controller 140 may identify a maximum output coil having the largest required power based on the required power of the plurality of coils 120.

In addition, the controller 140 may connect the maximum output coil to the first external power supply PS1. For example, the controller 140 may control the switching circuit 131 so that the first coil 121 having the largest required power is connected to the first external power supply PS1.

The cooking apparatus 100 connects the other coils to the second external power supply PS2 (1230).

Based on the required power of the plurality of coils 120, the controller 140 may identify the maximum output coil having the largest required power, and identify coils other than the maximum output coil.

In addition, the controller 140 may connect coils other than the maximum output coil to the second external power supply PS2. For example, the controller 140 may control the switching circuit 131 so that the coils 122, 123, and 124, which is other than the first coil 121, is connected to the second external power supply PS2.

Due to the power distribution operation 1200, it is possible to stably supply the power to the coil requiring the maximum output and it is possible to increase the maximum output of the plurality of coils 120 to the maximum power that can be supplied from the external power supply PS1.

As is apparent from the above description, it may be possible to increase a magnitude of a magnetic field output by coils overlapped with a cooking vessel.

It may be possible to supply power to each coil overlapped with a cooking vessel from a plurality of external power supplies.

It may be possible to supply power to each of a plurality of inverters from each of a plurality of rectifiers.

Various embodiments of the present disclosure have been described above. In the various embodiments described above, components may be implemented as a "module". Here, the term 'module' means, but is not limited to, a software and/or hardware component, such as a Field Programmable Gate Array (FPGA) or Application Specific Integrated Circuit (ASIC), which performs certain tasks. A module may advantageously be configured to reside on the addressable storage medium and configured to execute on one or more processors.

Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The operations provided for in the components and modules may be combined into fewer components and modules or further separated into additional components and modules. In addition, components and modules may be implemented such that they execute one or more CPUs in a device.

With that being said, and in addition to the above described various embodiments, embodiments can thus be implemented through computer readable code/instructions in/on a medium, e.g., a computer readable medium, to control at least one processing element to implement any above described various embodiment. The medium can correspond to any medium/media permitting the storing and/or transmission of the computer readable code.

The computer-readable code can be recorded on a medium or transmitted through the Internet. The medium may include Read Only Memory (ROM), Random Access Memory (RAM), Compact Disk-Read Only Memories (CD-ROMs), magnetic tapes, floppy disks, and optical recording medium. Also, the medium may be a non-transitory computer-readable medium. The media may also be a distributed network, so that the computer readable code is stored or transferred and executed in a distributed fashion. Still further, as only an example, the processing element could include at least one processor or at least one computer processor, and processing elements may be distributed and/or included in a single device.

While various embodiments have been described with respect to a limited number of embodiments, those skilled in the art, having the benefit of this disclosure, will appreciate that other embodiments can be devised which do not depart, from the scope as disclosed herein. Accordingly, the scope should be limited only by the attached claims.

Although the present disclosure has been described with various embodiments, various changes and modifications may be suggested to one skilled in the art. It is intended that the present disclosure encompass such changes and modifications as fall within the scope of the appended claims.

What is claimed is:

1. A cooking apparatus comprising:

a first coil and a second coil arranged in a first column;

a third coil and a fourth coil arranged in a second column;

a plurality of inverters configured to supply a drive current to the first coil, the second coil, the third coil, and the fourth coil;

a plurality of rectifiers configured to supply direct current (DC) power to the plurality of inverters;

a plurality of switches configured to connect each of the plurality of rectifiers to at least one of a first external power supply or a second external power supply, wherein:

the first external power supply is configured to supply power to at least one of the first coil, the second coil, the third coil, and the fourth coil, and the second external power supply is configured to supply power to at least one of the first coil, the second coil, the third coil, and the fourth coil; and a controller operably coupled to the plurality of switches and configured to:

determine whether a sum of power of the first coil and power of the second coil is greater than a reference power, based on the sum of power of the first coil and power of the second coil being greater than the reference power, control the plurality of switches such that the first external power supply supplies power to the first coil and the second external power supply supplies power to the second coil, determine whether the power of the first coil is greater than the power of the second coil, based on the power of the first coil being greater than the power of the second coil, control the plurality of switches such that the second external power supply supplies power to the third coil and the fourth coil, and based on the power of the second coil being greater than the power of the first coil, control the plurality of switches such that the first external power supply supplies power to the third coil and the fourth coil.

2. The cooking apparatus of claim 1, wherein:

the plurality of inverters comprises first, second, third, and fourth inverters configured to supply, a chive current to the first, second, third, and fourth coils, respectively;

the plurality of rectifiers comprises first, second, third, and fourth rectifiers configured to supply DC power to the first, second, third, and fourth inverters, respectively; and the plurality of switches comprises first, second, third, and fourth three-contact switches configured to connect each of the first, second, third, and fourth rectifiers, respectively, to at least one of the first external power supply or the second external power supply.

3. The cooking apparatus of claim 2, wherein, based on the sum of the power of the first coil and the power of the second coil being greater than the reference power, the controller is configured to control the first three-contact switch and the second three-contact switch such that the first rectifier is connected to the first external power supply and the second rectifier is connected to the second external power supply.

4. The cooking apparatus of claim 3, wherein, based on the power of the first coil being greater than the power of the second coil, the controller is configured to control the third three-contact switch and the fourth three-contact switch such that the third rectifier and the fourth rectifier are connected to the second external power supply.

5. The cooking apparatus of claim 1, wherein:

the plurality of inverters comprises first, second, third, and fourth inverters configured to supply a drive current to the first, second, third, and fourth coils, respectively;

the plurality of rectifiers comprises first and second rectifiers configured to supply DC power to the first and second inverters, respectively, and a third rectifier configured to supply DC power to the third and fourth inverters; and the plurality of switches comprises first, second, and third three-contact switches configured to connect each of the first, second, and third rectifiers, respectively, to at least one of the first external power supply or the second external power supply.

6. The cooking apparatus of claim 5, wherein, based on the sum of the power of the first coil and the power of the second coil being greater than the reference power, the controller is configured to control the first three-contact switch and the second three-contact switch such that the first rectifier is connected to the first external power supply and the second rectifier is connected to the second external power supply.

7. The cooking apparatus of claim 6, wherein, based on the power of the first coil not being greater than the power of the second coil, the controller is configured to control the third three-contact switch such that the third rectifier is connected to the second external power supply.

8. A control method of a cooking apparatus that is configured to supply power from a first external power supply and a second external power supply to a first coil, a second coil, a third coil, and a fourth coil, the control method comprising:

identifying power for each of the first coil, the second coil, the third coil, and the fourth coil based on a user input;

determining whether a sum of power of the first coil and power of the second coil is greater than a reference power;

based on the sum of power for the first coil and power of the second coil being greater than a reference power, supplying power from the first external power supply to the first coil and supplying power from the second external power supply to the second coil, determining whether the power of the first coil is greater than the power of the second coil;

based on the power of the first coil being greater than the power of the second coil, supplying power from the second external power supply to the third coil and the fourth coil; and based on the power of the second coil being greater than the power of the first coil, supplying power from the first external power supply to the third coil and the fourth coil.

9. The control method of claim 8, wherein power is supplied from the first external power supply and the second external power supply to the first coil, the second coil, the third coil, and the fourth coil by using first, second, third, and fourth switches configured to connect each of the first coil, the second coil, the third coil, and the fourth coil to at least one of the first external power supply or the second external power supply.

10. The control method of claim 9, further comprising:

based on the sum of the power of the first coil and the power of the second coil being greater than the reference power, controlling the first and second switches such that the first coil is connected to the first external power supply and the second coil is connected to the second external power supply.

11. The control method of claim 10, further comprising, based on the power of the first coil being greater than the power of the second coil, controlling the first and second switches such that the second external power supply supplies power to the third coil and the fourth coil.

12. The control method of claim 8, further comprising, based on the sum of the power of the first coil and the power of the second coil not being greater than the reference power and the sum of power of the third coil and power of the fourth coil not being greater than the reference power, supplying power from the first external power supply to the first coil and the second coil and supplying power from the second external power supply to the third coil and the fourth coil.

13. A cooking apparatus comprising:

a plurality of coils;

a plurality of inverters configured to supply a drive current to each of the plurality of coils;

a plurality of rectifiers configured to supply direct current (DC) power to each of the plurality of inverters;

a plurality of switches configured to connect each of the plurality of rectifiers to at least one of a first external power supply or a second external power supply; and a controller configured to:

control the plurality of switches such that the first external power supply supplies power to a first group of coils among the plurality of coils and the second external power supply supplies power to a second group of coils among the plurality of coils, determine whether a sum of power of the first group of coils is greater than a first reference power, based on a sum of power of the first group of coils being greater than the first reference power, control the plurality of switches such that the first and second external power supplies supply power to the first group of coils, determine whether a power of a first coil of the first group of coils is greater than a power of a second coil of the first group of coils, based on the power of the first coil of the first group of coils being greater than the power of the second coil of the first group of coils, control the plurality of switches such that the first external power supply supplies power to the first coil and the second external power supply supplies power to each of the coils other than the first coil, and based on a power of the second coil of the first group of coils being greater than a first coil of the first group of coils, control the plurality of switches such that the first external power supply supplies power to the second coil and the second external power supply supplies power to each of the coils other than the second coil.

14. The cooking apparatus of claim 13, wherein the first group of coils are arranged in a first column and the second group of coils are arranged in a second column.

15. The cooking apparatus of claim 13, wherein a number of the plurality of inverters is identical to a number of the plurality of rectifiers.

* * * * *